US010494064B2

(12) United States Patent
Vandenworm et al.

(10) Patent No.: US 10,494,064 B2
(45) Date of Patent: Dec. 3, 2019

(54) FLOATING DRILLER

(71) Applicant: Jurong Shipyard Pte Ltd, Singapore (SG)

(72) Inventors: Nicolaas Johannes Vandenworm, Houston, TX (US); John Williams Beck, III, Houston, TX (US)

(73) Assignee: Jurong Shipyard Pte Ltd, Singapore (SG)

( * ) Notice: Subject to any disclaimer, the term of this patent is extended or adjusted under 35 U.S.C. 154(b) by 0 days.

(21) Appl. No.: 15/798,078

(22) Filed: Oct. 30, 2017

(65) Prior Publication Data

US 2019/0152569 A1 May 23, 2019

(51) Int. Cl.

| | |
|---|---|
| ***B63B 21/50*** | (2006.01) |
| ***B63B 35/44*** | (2006.01) |
| ***E21B 41/00*** | (2006.01) |
| ***B63B 39/00*** | (2006.01) |
| ***B63B 22/02*** | (2006.01) |

(52) U.S. Cl.

CPC ..... *B63B 35/4413* (2013.01); *B63B 21/50* (2013.01); *B63B 22/021* (2013.01); *B63B 39/005* (2013.01); *E21B 41/0007* (2013.01); *B63B 2021/505* (2013.01); *B63B 2035/448* (2013.01)

(58) Field of Classification Search

CPC ..... B63B 35/44; B63B 35/4413; B63B 21/50

See application file for complete search history.

(56) References Cited

U.S. PATENT DOCUMENTS 4,281,615 A * 8/1981 Wilson ..... A62C 3/10 114/265

2009/0126616 A1* 5/2009 Srinivasan ..... B63B 35/44 114/264

FOREIGN PATENT DOCUMENTS

WO WO-2016137643 A1 * 9/2016 ..... B63B 1/041

* cited by examiner

*Primary Examiner* — Stephen P Avila

(74) *Attorney, Agent, or Firm* — Cesari and McKenna LLP

(57) ABSTRACT

A floating driller having a hull, a main deck, an upper cylindrical side section extending downwardly from the main deck, an upper frustoconical side section, a cylindrical neck section, a lower ellipsoidal section that extends from the cylindrical neck section, and a fin-shaped appendage secured to a lower and an outer portion of the exterior of a bottom surface. The upper frustoconical side section located below the upper cylindrical side section and maintained to be above the water line for a transport depth and partially below the water line for an operational depth of the floating driller.

12 Claims, 14 Drawing Sheets

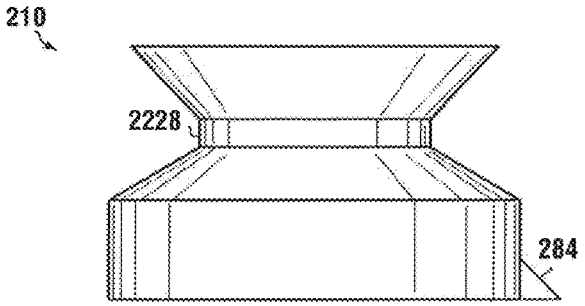
FIG. 25
FIG. 26
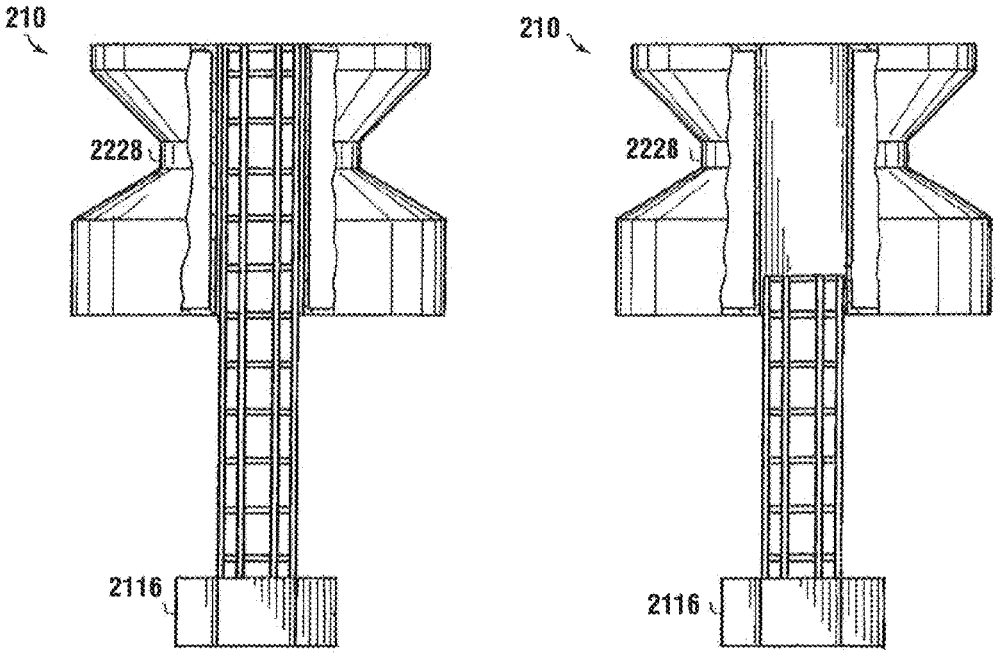

FLOATING DRILLER

CROSS REFERENCE TO RELATED APPLICATIONS

The present application claims priority to and the benefit of co-pending National Phase Application PCT/US2015/057397 filed on Oct. 26, 2015 which claims priority of U.S. patent application Ser. No. 14/524,992 filed on Oct. 27, 2014, entitled "BUOYANT STRUCTURE," which is a Continuation in Part of issued U.S. patent application Ser. No. 14/105,321 filed on Dec. 13, 2013, entitled "BUOYANT STRUCTURE," issued as U.S. Pat. No. 8,869,727 on Oct. 28, 2014, which is a Continuation in Part of issued U.S. patent application Ser. No. 13/369,600 filed on Feb. 9, 2012, entitled "STABLE OFFSHORE FLOATING DEPOT," issued as U.S. Pat. No. 8,662,000 on Mar. 4, 2014, which is a Continuation in Part of issued U.S. patent application Ser. No. 12/914,709 filed on Oct. 28, 2010, issued as U.S. Pat. No. 8,251,003 on Aug. 28, 2012, which claims the benefit of U.S. Provisional Patent Application Ser. No. 61/259,201 filed on Nov. 8, 2009 and U.S. Provisional Patent Application Ser. No. 61/262,533 filed on Nov. 18, 2009; and claims the benefit of U.S. Provisional Patent Application Ser. No. 61/521,701 filed on Aug. 9, 2011, both expired. These references are hereby incorporated in their entirety.

FIELD

The present embodiment generally relates to a floating driller and more particularly to hull designs and offloading systems for a floating drilling, production, storage and offloading (FDPSO) vessel.

DESCRIPTION OF THE RELATED ART

U.S. Pat. No. 6,761,508, issued to Haun and incorporated by reference ("the '508 patent"), is relevant to the present invention and provides the following background information concerning the development of offshore energy systems such as deepwater oil and/or gas production. Long flowlines, power cables and control umbilicals are frequently required between subsea wells and a host platform. The extended lengths pose energy loss, pressure drop and production difficulties. Costs of structures for deepwater applications are high and costs are frequently increased due to the foreign locations at which they are fabricated. Other difficulties, associated with deepwater offshore operations, result from floating vessel motions which affect personnel and efficiencies especially when related to liquid dynamics in tanks. The primary motion-related problem, associated with offshore petrochemical operations, occurs with large horizontal vessels in which the liquid level oscillates and provides erroneous signals to the liquid level instruments causing shutdown of processing and overall inefficiency for the operation.

The principal elements which can be modified for improving the motion characteristics of a moored floating vessel are the draft, the water plane area and its draft rate of change, location of the center of gravity (CG), the metacentric height about which small amplitude roll and pitching motions occur, the frontal area and shape on which winds, current and waves act, the system response of pipe and cables contacting the seabed acting as mooring elements, and the hydrodynamic parameters of added mass and damping.

The latter value are determined by complex solutions of the potential flow equations integrated over the floating vessel's detailed features and appendages and then simultaneously solved for the potential source strengths.

It is only significant to note herein that the addition of features which allow the added mass and/or damping to be 'tuned' for a certain condition requires that several features can be modified in combination, or more preferably independently, to provide the desired properties. The optimization is greatly simplified if the vessel possesses vertical axial symmetry, which reduces the six degrees of motion freedom to four, (i.e., roll=pitch=pendular motion, sway=surge=lateral motion, yaw=rotational motion, and heave=vertical motion).

It is further simplified if hydrodynamic design features may be de coupled to linearize the process and ease the ideal solution search.

The '508 patent provides for an offshore floating facility with improved hydrodynamic characteristics and the ability to moor in extended depths thereby providing a satellite platform in deep water resulting in shorter flowlines, cables and umbilicals from the subsea trees to the platform facilities. The design incorporates a retractable center assembly which contains features to enhance the hydrodynamics and allows for the integral use of vertical separators in a quantity and size providing opportunity for individual full time well flow monitoring and extended retention times.

A principal feature of the vessel described in the '508 patent is a retractable center assembly within the hull, which may be raised or lowered in the field to allow transit in shallow areas. The retractable center assembly provides a means of pitch motion damping, a large volumetric space for the incorporation of optional ballast, storage, vertical pressure or storage vessels, or a centrally located moon pool for deploying diving or remote operated vehicle (ROV) video operations without the need for added support vessels.

Hydrodynamic motion improvements of the vessel described in the '508 patent are provided by: the basic hull configuration; extended skirt and radial fins at the hull base; a (lowered at site) center assembly extending the retractable center section with base and mid-mounted hydrodynamic skirts and fins, the mass of the separators below the hull deck that lowers the center of gravity; and attachment of the steel catenary risers, cables, umbilicals and mooring lines near the center of gravity at the hull base. The noted features improve vessel stability and provide increased added mass and damping, which improves the overall response of the system under environmental loading.

A plan view of the hull of the vessel described in the '508 patent shows a hexagonal shape. U.S. Patent Application Publication No. 2009/0126616, which lists Srinivasan as inventor, shows a floating driller having an octagonal hull in a plan view.

The Srinivasan floating driller is characterized in its claims as having a polygonal exterior side wall configuration with sharp comers to cut ice sheets, resist and break ice and move ice pressure ridges away from the vessel.

U.S. Pat. No. 6,945,736, issued to Smedal et al. and incorporated by reference ("the '736 patent"), is directed to a drilling and production platform consisting of a semi-submersible platform body having the shape of a cylinder having a flat bottom and a circular cross-section.

The vessel in the '736 patent has a peripheral circular cut-out or recess in a lower part of the cylinder, and the patent states the design provides a reduction in pitching and rolling movement. Because the floating driller may be connected to production risers and, in general, need to be stable, even during storm conditions, there remains a need for improvements in vessel hull design.

Further, there is a need for improvement in offloading product from a floating driller to a ship or tanker that transports the product from the floating driller to an onshore facility.

As part of an offloading system, a catenary anchor leg mooring (CALM) buoy is typically anchored near the floating driller. U.S. Pat. No. 5,065,687, issued to Hampton, provides an example of a buoy in an offloading system in which the buoy is anchored to the seabed so as to provide a minimum distance from a nearby the floating driller.

In this example, a pair of cables attaches the buoy to the floating driller, and an offloading hose extends from the floating driller to the buoy. A tanker is moored temporarily to the buoy, and a hose is extended from the tanker to the buoy for receiving product from the floating driller through the hoses connected through the buoy. If adverse weather conditions, such as a storm with significant wind speeds, occur during offloading, problems can occur due to movement of the tanker caused by wind and current forces acting on the tanker. Thus, there is also a need for an improvement in the offloading system typically used in transferring product stored on the floating driller to a tanker.

BRIEF DESCRIPTION OF THE DRAWINGS

A better understanding of the invention can be obtained when the detailed description of exemplary embodiments set forth below is considered in conjunction with the attached drawings in which:

FIG. 25 is detailed view of the buoyant structure with a cylindrical neck.

FIG. 26 is a cut away view of the buoyant structure with a cylindrical neck in a transport configuration.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

Specific structural and functional details disclosed herein are not to be interpreted as limiting, but merely as a basis of the claims and as a representative basis for teaching persons having ordinary skill in the art to variously employ the present invention.

The present invention provides a floating driller with several alternative hull designs, several alternative center column design and a moveable hawser system for offloading, which allows a tanker to weathervane over a wide arc with respect to the floating driller.

The floating driller has a hull with a hull plan view that is circular or polygonal. The hull has a bottom surface, top deck surface, and at least two connected sections engaging the bottom surface and the top deck surface.

The connected sections are joined in series and symmetrically configured about the vertical axis with one of the connected sections extending downwardly from the top deck surface toward the bottom surface.

The connected sections contain at least two of the following: an upper portion in plan view with a sloping side extending from the top deck section, a cylindrical neck section in plan view, and a lower conical section in plan view with a sloping side extending from the cylindrical neck section.

The floating driller also has at least one extending fin, with an upper fin surface, sloping towards the bottom surface and secured to and extending from the hull.

The fin is configured to provide hydrodynamic performance through linear and quadratic damping.

The hull of the floating driller provides added mass with improved hydrodynamic performance through linear and quadratic damping.

These characteristics prevent the floating driller from requiring a retractable center column to control pitch, roll and heave.

Figure 1:
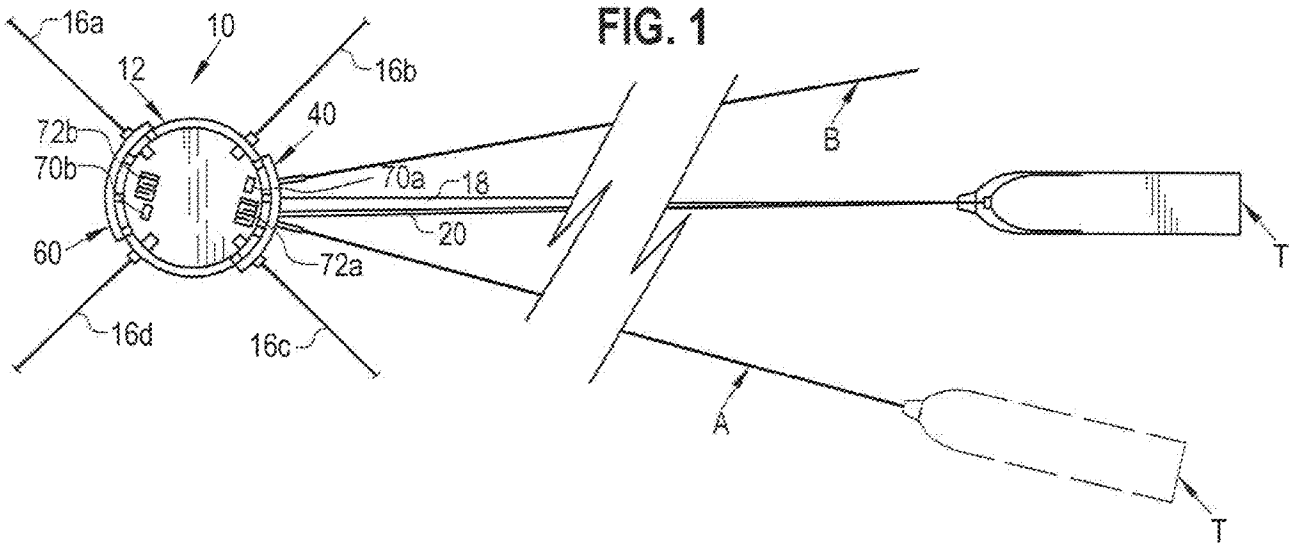
FIG. 1 is a top plan view of the floating driller, according to the present invention, and a tanker moored to the floating driller.
Figure 2:
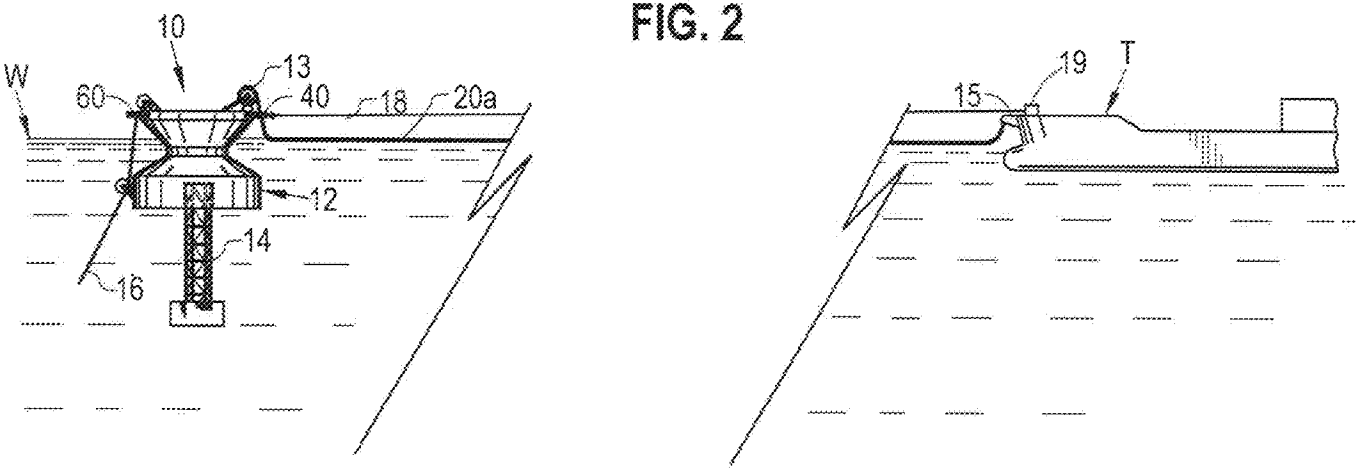
FIG. 2 is a side elevation of the floating driller of FIG. 1.

Turning now to the figures, the floating driller is shown in a plan view in FIG. 1 and in a side elevation in FIG. 2, according to the present invention. Floating driller 10 has a hull 12, and a center column 14 can be attached to hull 12 and extend downwardly.

The floating driller 10 floats in water W and can be used in the production, storage and/or offloading of resources extracted from the earth, such as hydrocarbons including crude oil and natural gas and minerals such as can be extracted by solution mining. The floating driller 10 can be assembled onshore using known methods, which are similar to shipbuilding, and towed to an offshore location, typically above an oil and/or gas field in the earth below the offshore location.

Anchor lines 16*a*-16*d*, which would be fastened to anchors in the seabed that are not shown, moor floating driller 10 in a desired location. The anchor lines are referred to generally as anchor lines 16, and elements described herein that are similarly related to one another will share a common numerical identification and be distinguished from one another by a suffix letter.

In a typical application for the floating driller 10, crude oil is produced from the earth below the seabed below the floating driller 10, transferred into and stored temporarily in hull 12, and offloaded to a tanker T for transport to onshore facilities.

Tanker T is moored temporarily to the floating driller 10 during the offloading operation by a hawser 18. A hose 20 is extended between hull 12 and tanker T for transfer of crude oil and/or another fluid from the floating driller 10 to tanker T.

Figure 3:
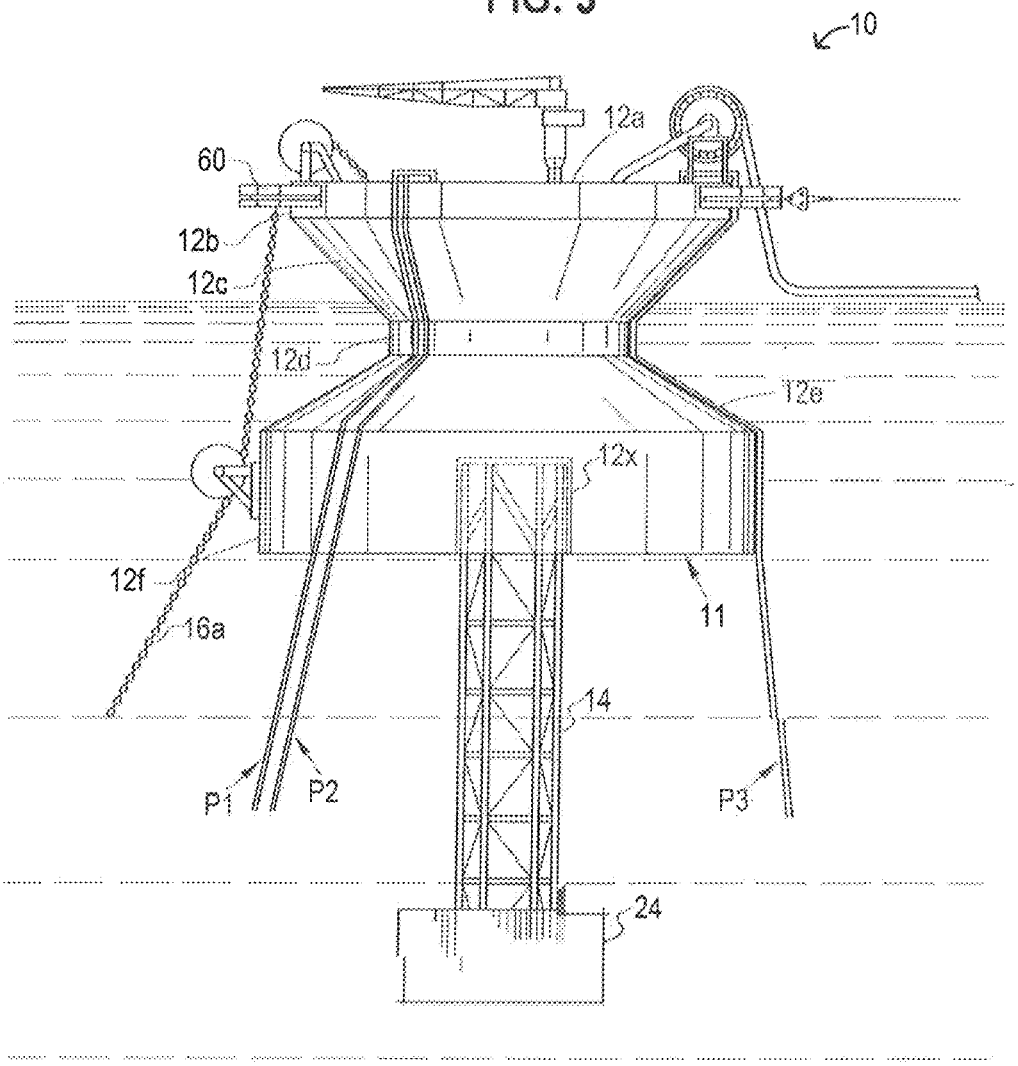
FIG. 3 is an enlarged and more detailed version of the side elevation of the floating driller shown in FIG. 2.

FIG. 3 is a side elevation of the floating driller 10.

Figure 4:
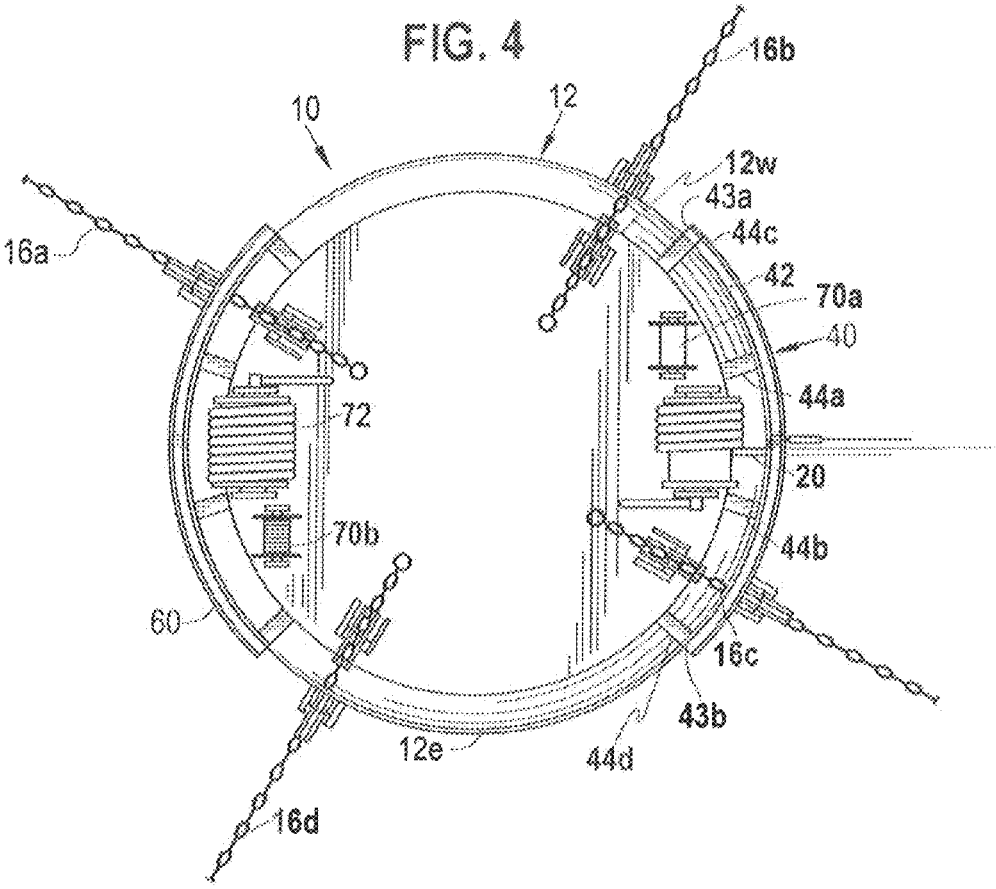
FIG. 4 is an enlarged and more detailed version of the top plan view of the floating driller shown in FIG. 1.

FIG. 4 is a top plan view of the floating driller 10, and each view is larger and shows more detail than the corresponding FIGS. 2 and 1, respectively.

Hull 12 of the floating driller 10 has a circular top deck surface 12*a*, an upper cylindrical portion 12*b* extending downwardly from deck surface 12*a*, an upper conical section 12*c* extending downwardly from upper cylindrical portion 12*b* and tapering inwardly, a cylindrical neck section 12*d* extending downwardly from upper conical section 12*c*, a lower conical section 12*e* extending downwardly from neck section 12*d* and flaring outwardly, and a lower cylindrical section 12*f* extending downwardly from lower conical section 12*e*. Lower conical section 12*e* is described herein as having the shape of an inverted cone or as having an inverted conical shape as opposed to upper conical section 12*c*, which is described herein as having a regular conical shape. The floating driller 10 preferably floats such that the surface of the water intersects regular, upper conical section 12*c*, which is referred to herein as the waterline being on the regular cone shape.

The floating driller 10 is preferably loaded and/or ballasted to maintain the waterline on a bottom portion of regular, upper conical section 12*c*.

When the floating driller 10 is installed and floating properly, a cross-section of hull 12 through any horizontal plane has preferably a circular shape.

Hull 12 can be designed and sized to meet the requirements of a particular application, and services can be requested from Maritime Research Institute (Marin) of The Netherlands to provide optimized design parameters to satisfy the design requirements for a particular application.

In this embodiment, upper cylindrical section 12*b* has approximately the same height as the neck section 12*d*, while the height of lower cylindrical section 12*f* is about 3 or 4 times greater than the height of upper cylindrical section 12*b*. Lower cylindrical section 12*f* has a greater diameter than upper cylindrical section 12*b*. Upper conical section 12*c* has a greater height than lower conical section 12*e*.

Figure 5:
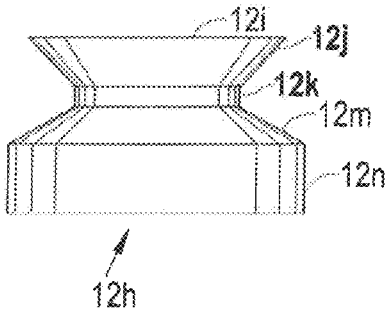
FIG. 5 is a side elevation of an alternative embodiment of the hull for a floating driller, according to the present invention.
Figure 6:
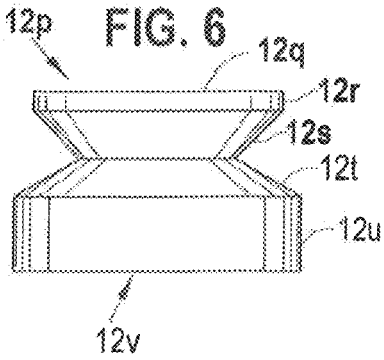
FIG. 6 is a side elevation of an alternative embodiment of the hull for a floating driller, according to the present invention.

FIGS. 5 and 6 are side elevations showing alternative designs for the hull. FIG. 5 shows a hull 12*h* that has a circular top deck surface 12*i*, which would be essentially identical to top deck surface 12*a*, on a top portion of an upper conical section 12*j* that tapers inwardly as it extends downwardly.

A cylindrical neck section 12*k* is attached to a lower end of upper conical section 12*j* and extends downwardly from upper conical section 12*j*. A lower conical section 12*m* is attached to a lower end of neck section 12*k* and extends downwardly from neck section 12*k* while flaring outwardly.

A lower cylindrical section 12*n* is attached to a lower end of lower conical section 12*m* and extends downwardly from lower conical section 12*m*.

A significant difference between hull 12*h* and hull 12 is that hull 12*h* does not have an upper cylindrical portion corresponding to upper cylindrical portion 12*b* in hull 12. Otherwise, upper conical section 12*j* corresponds to upper conical section 12*c*; neck section 12*k* corresponds to neck section 12*d*; lower conical section 12*m* corresponds to lower conical section 12*e*; and lower cylindrical section 12*n* corresponds to lower cylindrical section 12*f*.

Each of lower cylindrical section 12*n* and lower cylindrical section 12*f* has a circular bottom deck that is not shown, but which is similar to circular top deck surface 12*a*, except center section 14 extends downwardly from the circular bottom deck.

FIG. 6 is a side elevation of a hull 12*p*, which has a top deck 12*q* that looks like top deck surface 12*a*. An upper cylindrical section 12*r* extends downwardly from top deck 12*q* and corresponds to upper cylindrical section 12*b*.

An upper conical section 12*s* is attached to a lower end of upper cylindrical section 12*r* and extends downwardly while tapering inwardly. Upper conical section 12*s* corresponds to upper conical section 12*c* in FIG. 1.

Hull 12*p* in FIG. 6 does not have a cylindrical neck section that corresponds to cylindrical neck section 12*d* in FIG. 3. Instead, an upper end of a lower conical section 12*t* is connected to a lower end of upper conical section 12*s*, and lower conical section 12*t* extends downwardly while flaring outwardly.

Lower conical section 12*t* in FIG. 6 corresponds to lower conical section 12*e* in FIG. 3. A lower cylindrical section 12*u* is attached at an upper end, such as by welding, to a lower end of lower conical section 12*t* and extends downwardly, essentially corresponding in size and configuration to lower cylindrical section 12*f* in FIG. 3.

A bottom plate 12*v* (not shown) encloses a lower end of lower cylindrical section 12*u*, and the lower end of hull 12 in FIG. 3 and hull 12*h* in FIG. 5 are similarly enclosed by a bottom plate, and each of the bottom plates can be adapted to accommodate a respective center column corresponding to center column 14 in FIG. 3.

Turning now to FIGS. 7-11, alternative embodiments for a center column are illustrated.

Figure 7:
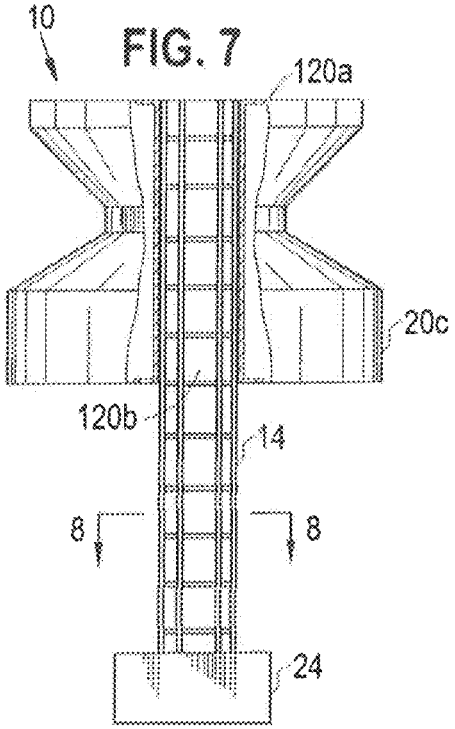
FIG. 7 is a side elevation of an alternative embodiment of a floating driller, according to the present invention, showing a center column received in a bore through the hull of the floating driller.

FIG. 7 is a side elevation of the floating driller 10 partially cut away to show a center column 14 according to the present invention. The floating driller 10 has a top deck surface that has an opening 120*b* through which center column 14 can pass. In this embodiment, center column 14 can be retracted, and an upper end of center column 14 can be raised above top deck surface.

If center column 14 is fully retracted, the floating driller 10 can be moved through shallower water than if center column 14 is fully extended.

U.S. Pat. No. 6,761,508, issued to Haun, provides further details relevant to this and other aspects of the present invention and is incorporated by reference in its entirety.

FIG. 7 shows center column 14 partially retracted, and center column 14 can be extended to a depth where upper end is located within a lowermost cylindrical portion 20*c* of the floating driller 10.

Figure 8:
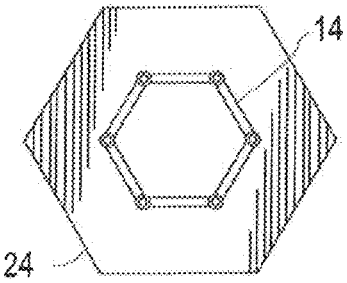
FIG. 8 is a cross section of the center column of FIG. 7, as seen along the line 8-8.

FIG. 8 is a cross section of center column 14 as seen along the line 8-8 in FIG. 7, and FIG. 8 shows a plan view of a mass trap 24 located on a bottom end of center column 14. Mass trap 24, which is shown in this embodiment as having a hexagonal shape in its plan view, is weighted with water for stabilizing the floating driller 10 as it floats in water and is subject to wind, wave, current and other forces. Center column 14 is shown in FIG. 8 as having a hexagonal cross-section, but this is a design choice.

Figure 9:
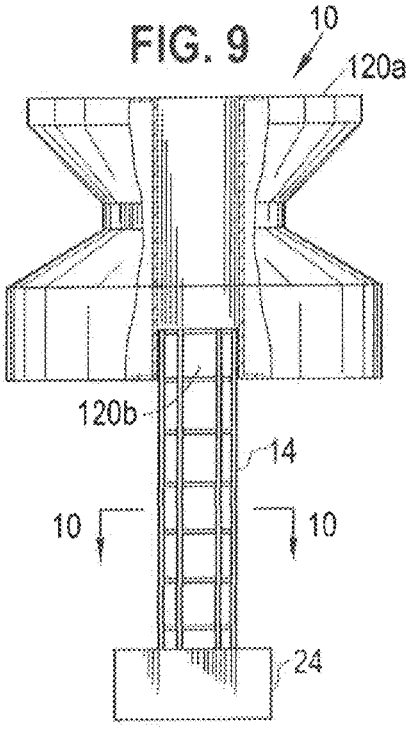
FIG. 9 is a side elevation of the floating driller of FIG. 7 showing an alternative embodiment of the center column, according to the present invention.

FIG. 9 is a side elevation of the floating driller 10 of FIG. 7 partially cut away to show a center column 14, according to the present invention. Center column 14 is shorter than center column 14 in FIG. 7.

An upper end center column 14 can be moved up or down within opening 120*b* in the floating driller 10, and with center column 14, the floating driller 10 can be operated with only a couple or a few meters of center column 14 protruding below the bottom of the floating driller 10.

A mass trap 24, which may be filled with water to stabilize the floating driller 10, is secured to a lower end of center column 14.

Figure 10:
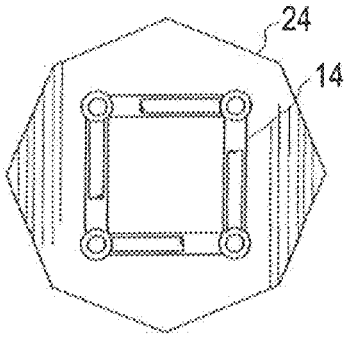
FIG. 10 is a cross section of the center column of FIG. 9, as seen along the line 10-10.

FIG. 10 is a cross-section of center column 14 as seen along the line 10-10 in FIG. 9. In this embodiment of a center column, center column 14 has a square cross-section, and mass trap 24 has an octagonal shape in the plan view of FIG. 10.

Figure 11:
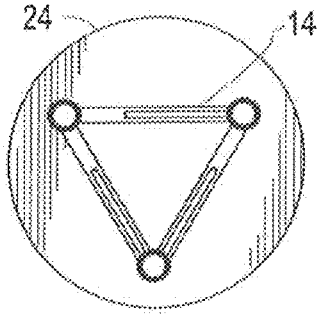
FIG. 11 is an alternative embodiment of a center column and a mass trap as would be seen along the line 10-10 in FIG. 9, according to the present invention.

In an alternative embodiment of the center column in FIG. 9 as seen along the line 10-10, a center column 14 and a mass trap 24 are shown in FIG. 11 in a top plan view. In this embodiment, center column 14 has a triangular shape in a transverse cross-section, and mass trap 24 has a circular shape in a top plan view.

Returning to FIG. 3, the floating driller hull 12 has a cavity or recess 12*x* shown in phantom lines, which is a centralized opening into a bottom portion of lower cylindrical section 12*f* of the floating driller's hull 12.

An upper end of central column 14 protrudes into essentially the full depth of recess 12*x*. In the embodiment illustrated in FIG. 3, center column 14 is effectively cantilevered from the bottom of lower cylindrical section 12*f*, much like a post anchored in a hole, but with the center column 14 extending downwardly into the water upon which the floating driller's hull floats.

A mass trap 24 for containing water weight to stabilize hull is attached to a lower end of center column 14. Various embodiments of a center column have been described; however, the center column is optional and can be eliminated entirely or replaced with a different structure that protrudes from the bottom of the floating driller 10 and helps to stabilize the vessel.

One application for the floating driller 10 illustrated in FIG. 3 is in production and storage of hydrocarbons such as crude oil and natural gas and associated fluids and minerals and other resources that can be extracted or harvested from the earth and/or water.

As shown in FIG. 3, production risers P1, P2 and P3 are pipes or tubes through which, for example, crude oil may flow from deep within the earth to the floating driller 10, which has significant storage capacity within tanks within the hull. In FIG. 3, production risers P1, P2 and P3 are illustrated as being located on an outside surface of the hull, and production would flow into hull 12 through openings in top deck surface 12*a*.

An alternative arrangement is available in the floating driller 10 shown in FIGS. 7 and 9, where it is possible to locate production risers within openings 120*a* and 120*b* that provides an open throughway from the bottom of the floating driller 10 to the top of the floating driller 10. Production risers are not shown in FIGS. 7 and 9, but can be located on an outside surface of the hull or within opening 120*b*. An upper end of a production riser can terminate at a desired location with respect to the hull so that production flows directly into a desired storage tank within the hull.

The floating driller 10 of FIGS. 7 and 9 can also be used to drill into the earth to discover or to extract resources, particularly hydrocarbons such as crude oil and natural gas, making the vessel a floating driller.

For this application, mass trap 24 would have a central opening from a top surface to a bottom surface 11 through which drill string can pass, which is a structural design that can also be used for accommodating production risers within opening 120*b* in the floating driller 10.

A derrick (not shown) would be provided on a top deck surface of the floating driller 10 for handling, lowering, rotating and raising drill pipe and an assembled drill string, which would extend downwardly from the derrick through opening 120*b* in the floating driller 10, through an interior portion of center column 14, through a central opening (not shown) in mass trap 24, through the water and into the seabed below.

After drilling is successfully completed, production risers can be installed, and the resource, such as crude oil and/or natural gas, can be received and stored in tankage located within the floating driller.

U.S. Patent Application Publication No. 2009/0126616, which lists Srinivasan as a sole inventor, describes an arrangement of tankage in the hull of the floating driller for oil and water ballast storage and is incorporated by reference. In one embodiment of the present invention, a heavy ballast, such as a slurry of hematite and water, can be used, preferably in outer ballast tanks.

Slurry is preferred, preferably 1 part hematite and 3 parts water, but permanent ballast, such as a concrete could be used. A concrete with a heavy aggregate, such as hematite, barite, limonite, magnetite, steel punchings and shot, can be used, but preferably a high-density material is used in a slurry form. Drilling, production and storage aspects of the floating drilling, production, storage and offloading vessel of the present invention have thus been described, which leaves the offloading function of the floating driller.

Turning to the offloading function of the floating driller of the present invention, FIGS. 1 and 2 illustrate transport tanker T moored to the floating driller 10 by hawser 18, which is a rope or a cable, and hose 20 has been extended from the floating driller 10 to tanker T.

The floating driller 10 is anchored to the seabed through anchor lines 16*a*, 16*b*, 16*c* and 16*d*, while tanker T's location and orientation is effected by wind direction and force, wave action and force and direction of current. Consequently, tanker T weathervanes with respect to the floating driller 10 because its bow is moored to the floating driller 10 while its stem moves into an alignment determined by a balance of forces. As forces due to wind, wave and current change, tanker T may move to the position indicated by phantom line A or to the position indicated by phantom line B. Tugboats or a temporary anchoring system, neither of which is shown, can be used to keep tanker T a minimum, safe distance from the floating driller 10 in case of a change in net forces that causes tanker T to move toward the floating driller 10 rather than away from the floating driller 10 so that hawser 18 remains taut.

If wind, wave, current (and any other) forces remained calm and constant, tanker T would weathervane into a position in which all forces acting on the tanker were in balance, and tanker T would remain in that position. However, that is generally not the case in a natural environment. Particularly, wind direction and speed or force changes from time to time, and any change in the forces acting on tanker T cause tanker T to move into a different position in which the various forces are again in balance. Consequently, tanker T moves with respect to the floating driller 10 as various forces acting upon tanker T change, such as the forces due to wind wave and current action.

Figure 12:
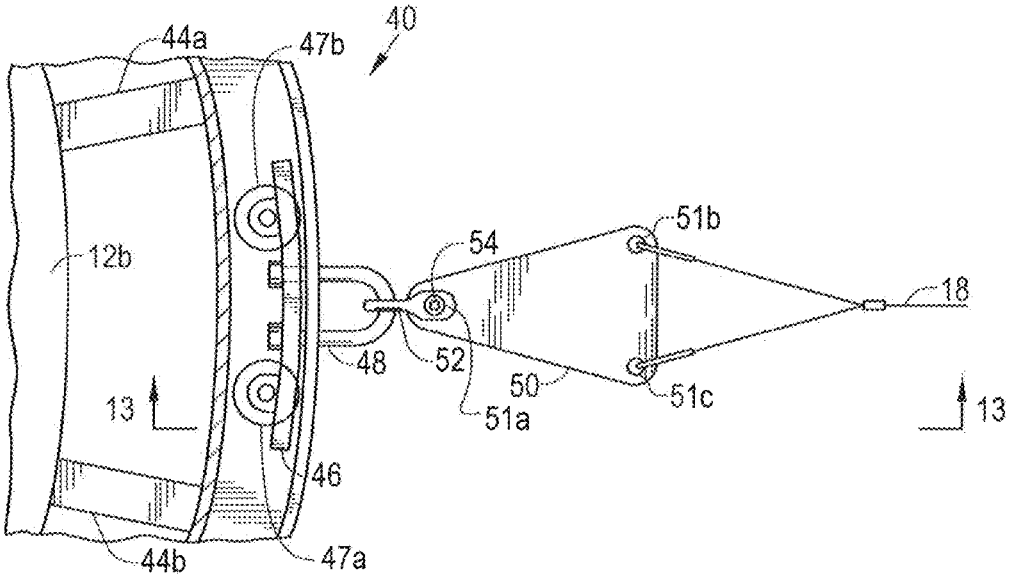
FIG. 12 is a top plan view of a moveable hawser connection, according to the present invention.
Figure 13:
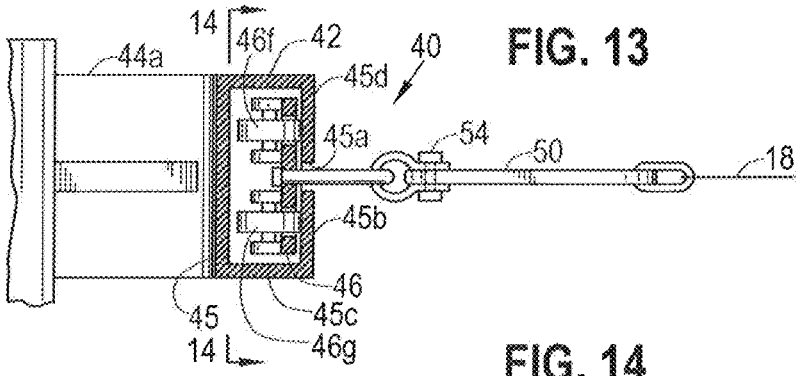
FIG. 13 is a side elevation of the moveable hawser connection of FIG. 12 in partial cross-section as seen along the line 13-13.
Figure 14:
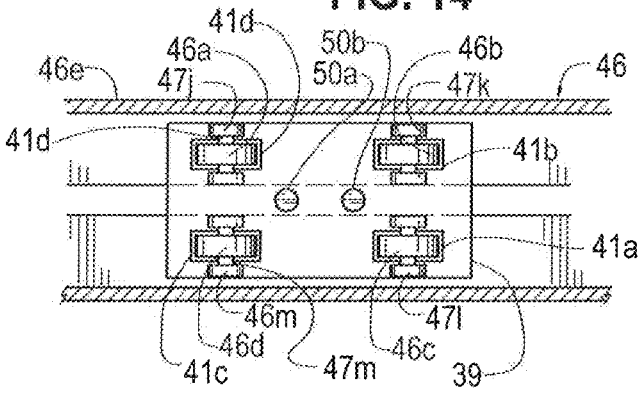
FIG. 14 is a side elevation of the moveable hawser connection of FIG. 13 in partial cross-section as seen along the line 14-14.

FIGS. 12-14, in conjunction with FIGS. 1 and 2, illustrate a moveable hawser connection 40 on the floating driller 10, according to the present invention, which helps to accommodate movement of the transport tanker with respect to the floating driller 10.

FIG. 12-14 depict is a plan view of moveable hawser connection 40 in partial cross-section.

FIG. 12-14 depict moveable hawser connection 40 comprises in one embodiment a nearly fully enclosed tubular channel 42 that has a rectangular cross-section and a longitudinal slot on a side wall of the hull 12*b*; a set of standoffs, including stand-offs 44*a* and 44*b*, that connect tubular channel 42 horizontally to an outside, upper wall 12*w* of hull 12 in FIGS. 1-4; a trolley 46 captured and moveable within tubular channel 42; a trolley shackle 48 attached to trolley 46 and providing a connection point; and a plate 50 pivotably attached to trolley shackle 48 through a plate shackle 52. Plate 50 has a generally triangular shape with the apex of the triangle attached to plate shackle 52 through a pin 54 passing through a hole in plate shackle 50. Plate 50 has a hole 50*a* adjacent another point of the triangle and a hole 50*b* adjacent the final point of the triangle.

FIG. 12-14 depict hawser 18 terminating with dual connection points 51*a* and 51*b*, which are connected to plate 50 by passing through holes 50*a* and 50*b*, respectively. Alternatively, dual ends 51*b* and 51*c*, plate 50 and/or shackle 52 can be eliminated, and hawser 18 can be connected directly to shackle 48, and other variations in how the hawser 18 is connected to trolley 46 are available.

FIG. 13 is a side elevation of moveable hawser connection 40 in partial cross-section as seen along the line 13-13 in FIG. 12.

A side elevation of tubular channel 42 is shown in cross-section. The wall of the tubular channel can have a slot that is a relatively tall, as well as a vertical outer wall, and an outside surface of an opposing inner wall that is equal in height.

Stand-offs 44*a*,44*b* are attached, such as by welding, to the outside surface of inner wall 45*c*. A pair of opposing, relatively short, horizontal walls 45*d* and 45*e* extend between vertical walls 45*b* and 45*a* to complete the enclosure of tubular channel 42, except vertical wall has the horizontal, longitudinal slot that extends nearly the full length of tubular channel 42.

FIG. 12-14 is a side elevation with a tubular channel 42 in partial cross-section in order to show a side elevation of trolley 46. Trolley 46 comprises a base plate 46*e*, which has four rectangular openings 41*a*-41*d*, for receiving four wheels 46*a*-46*d*, respectively, which are mounted on four axles 47*j*-47*m* respectively, that are attached through standoffs to base plate 46*a*.

Tanker T is moored to the floating driller 10 in FIGS. 1-4 through hawser 18, which is attached to moveable trolley 46 through plate 50 and shackles 48 and 52. As wind, wave, current and/or other forces act on tanker T, tanker T can move in an arc about the floating driller 10 at a radius determined by the length of hawser 18 because trolley 46 is free to roll back and forth in a horizontal plane within tubular channel 42.

As best seen in FIG. 4, tubular channel 42 extends in about a 90-degree arc about hull 12 of the floating driller 10. Tubular channel 42 has opposing ends each of which is enclosed for providing a stop for trolley. Tubular channel 42 has a radius of curvature that matches the radius of curvature of outside wall 12*w* of hull 12 because standoffs 44*a*, 44*b*, 44*c* and 44*d* are equal in length. Trolley 46 is free to roll back and forth within enclosed tubular channel 42 between ends of tubular channel 42. Standoffs 44*a*, 44*b*, 44*c* and 44*d* space tubular channel away from outside wall 12*w* of hull 12, and hose 20 and anchor line 16*c* pass through a space defined between outer wall 12*w* and inside wall 42*c* of tubular channel 42.

Typically, wind, wave and current forces will position tanker T in a position, with respect to the floating driller 10, referred to herein as downwind of the floating driller 10. Hawser 18 is taut and in tension as wind, wave and current action applies a force on tanker T that attempts to move tanker T away from and downwind of the stationary floating driller 10. Trolley 46 comes to rest within tubular channel 42 due to a balance of forces that neutralizes a tendency for trolley 46 to move. Upon a change in wind direction, tanker T can move with respect to the floating driller 10, and as tanker T moves, trolley 46 will roll within tubular channel 42 with the wheels 46*f* and 46*g* pressed against an inside surface of wall of tubular channel 42. As the wind continues in its new, fixed direction, trolley 46 will settle within tubular channel 42 where forces causing trolley 46 to roll are neutralized. One or more tugboats can be used to limit the motion of tanker T to prevent tanker T from moving too close to the floating driller 10 or from wrapping around the floating driller 10, such as due to a substantial change in wind direction.

For flexibility in accommodating wind direction, the floating driller 10 preferably has a second moveable hawser connection 60 positioned opposite of moveable hawser connection 40. Tanker T can be moored to either moveable hawser connection 40 or to moveable hawser connection 60, depending on which better accommodates tanker T downwind of the floating driller 10. Moveable hawser connection 60 is essentially identical in design and construction to moveable hawser 40 with its own slotted tubular channel and trapped, free-rolling trolley car having a shackle protruding through the slot in the tubular channel.

Each moveable hawser connection 40 and 60 is believed to be capable of accommodating movement of tanker T within about a 270-degree arc, so a great deal of flexibility is provided both during a single offloading operation (by movement of the trolley within one of the moveable hawser connections) and from one offloading operation to another (by being able to choose between opposing moveable hawser connections).

Wind, wave and current action can apply a great deal of force on tanker T, particularly during a storm or squall, which in turn applies a great deal of force on trolley 46, which in turn applies a great deal of force on slotted the wall (FIG. 13) of tubular channel 42. Slot 42 weakens wall, and if enough force is applied, wall can bend, possibly opening slot 42*a* wide enough for trolley 46 to be ripped out of tubular channel 42.

Tubular channel 42 will need to be designed and built to withstand anticipated forces. Inside comers within tubular channel 42 may be built up for reinforcement, and it may be possible to use wheels that have a spherical shape. The tubular channel is just one means for providing a moveable hawser connection. An I-beam, which has opposing flanges attached to a central web, could be used as a rail instead of the tubular channel, with a trolley car or other rolling or sliding device trapped to, and moveable on, the outside flange. The moveable hawser connection is similar to a gantry crane, except a gantry crane is adapted to accommodate vertical forces, while the moveable hawser connection needs to be adapted to accommodate a horizontal force exerted through the hawser 18.

Any type of rail, channel or track can be used in the moveable hawser connection, provided a trolley or any kind of rolling, moveable or sliding device can move longitudinally on, but is otherwise trapped on, the rail, channel or track. The following patents are incorporated by reference for all that they teach and particularly for what they teach about how to design and build a moveable connection. U.S. Pat. No. 5,595,121, entitled "Amusement Ride and Self-propelled Vehicle Therefor" and issued to Elliott et al.; U.S. Pat. No. 6,857,373, entitled "Variably Curved Track-Mounted Amusement Ride" and issued to Checketts et al.; U.S. Pat. No. 3,941,060, entitled "Monorail System" and issued to Morsbach; U.S. Pat. No. 4,984,523, entitled "Self-propelled Trolley and Supporting Track Structure" and issued to Dehne et al.; and U.S. Pat. No. 7,004,076, entitled "Material Handling System Enclosed Track Arrangement" and issued to Traubenkraut et al., are all incorporated by reference in their entirety for all purposes. As described herein and in the patents incorporated by reference, a variety of means can be used to resist a horizontal force, such as applied on the floating driller 10 through hawser 18 from tanker T, while providing lateral movement, such as by trolley 46 rolling back and forth horizontally while trapped within tubular channel 42.

Wind, waves and current apply a number of forces on the FDPSO or the floating driller of the present invention, which causes a vertical up and down motion or heave, in addition to other motions.

A production riser is a pipe or tube that extends from a wellhead on the seabed to the FDPSO or the floating driller, which is referred to herein generally as the floating driller. The production riser can be fixed at the seabed and fixed to the floating driller. Heave on the floating driller can place alternating tension and compression forces on the production riser, which can cause fatigue and failure in the production riser. One aspect of the present invention is to minimize the heave of the floating driller.

Figure 15:
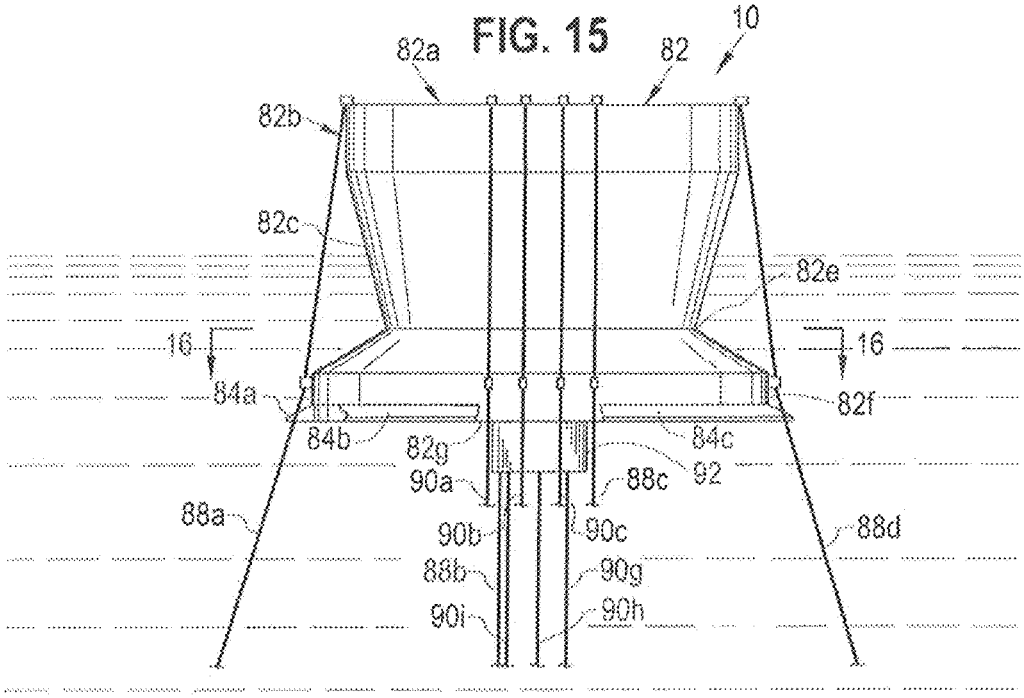
FIG. 15 is a side elevation of a vessel, according to the present invention.

FIG. 15 is a side elevation of the floating driller 10 according to the present invention. Floating Driller 10 has a hull 82 and a circular top deck surface 82*a*, and a cross-section of hull 82 through any horizontal plane, while hull 82 is floating and a rest, has preferably a circular shape.

An upper cylindrical section 82*b* extends downwardly from deck surface 82*a*, and an upper conical section 82*c* extends downwardly from upper cylindrical portion 82*b* and tapers inwardly. Floating Driller 10 could have a cylindrical neck section 82*d* extending downwardly from upper conical section 82*c*, which would make it more similar to Floating Driller 10 in FIG. 3, but it does not. Instead, a lower conical section 82*e* extends downwardly from upper conical section 82*c* and flares outwardly. A lower cylindrical section 82*f* extends downwardly from lower conical section 82*e*. Hull 82 has a bottom surface 82*g*.

Lower conical section 82*e* is described herein as having the shape of an inverted cone or as having an inverted conical shape as opposed to upper conical section 82*c*, which is described herein as having a regular conical shape. The floating driller 10 is shown as floating such that the surface of the water intersects the upper cylindrical portion 82*b* when loaded and/or ballasted. In this embodiment, upper conical section 82*c* has a substantially greater vertical height than lower conical section 82*e*, and upper cylindrical section 82*b* has a slightly greater vertical height than lower cylindrical section 82*f*.

For reducing heave and otherwise steadying Floating Driller 10, a set of fins 84 is attached to a lower and outer portion of lower cylindrical section 82*f*, as shown in FIG. 15.

Figure 16:
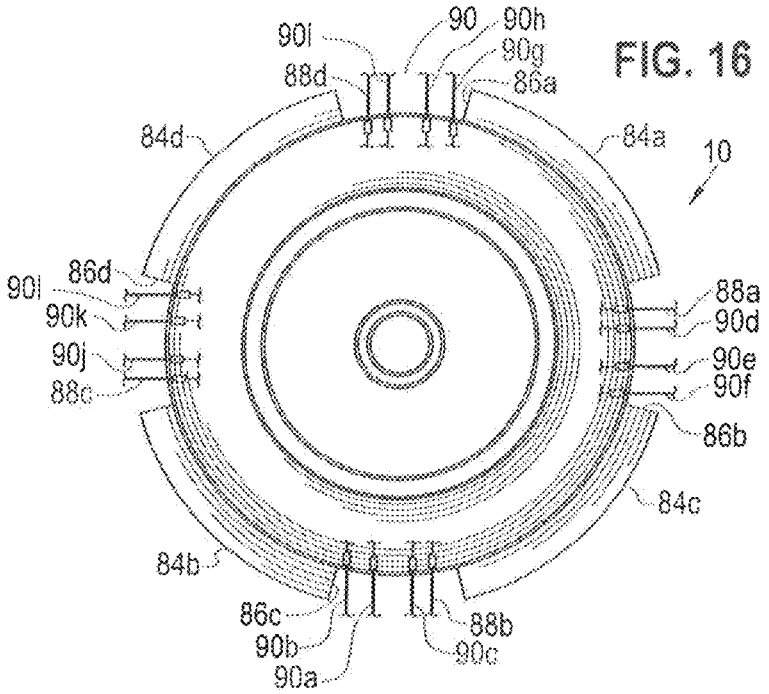
FIG. 16 is a cross section of the vessel of FIG. 15 as seen along the line 16-16.

FIG. 16 is a cross-section of Floating Driller 10 as would be seen along the line 16-16 in FIG. 15. As can be seen in FIG. 16, fins 84 comprise four fin sections 84*a*, 84*b*, 84*c* and 84*d*, which are separated from each other by gaps 86*a*, 86*b*, 86*c* and 86*d* (collectively referred to as gaps 86). Gaps 86 are spaces between fin sections 84*a*, 84*b*, 84*c* and 84*d*, which provide a place that accommodates production risers and anchor lines on the exterior of hull 82, without contact with fins 84.

Anchor lines 88*a*, 88*b*, 88*c* and 88*d* in FIGS. 15 and 16 are received in gaps 86*c*, 86*a*, 86*b* and 86*d*, respectively, and secure the floating driller 10 to the seabed. Production risers 90*a*, 90*b*, 90*c*, 90*d*, 90*e*, 90*f*, 90*g*, 90*h*, 90*i*, 90*j*, 90*k*, and 901 are received in the gaps 86*a-c* and deliver a resource, such as crude oil, natural gas and/or a leached mineral, from the earth below the seabed to tankage within the floating driller 10. A center section 92 extends from bottom 82*g* of hull 82.

Figure 17:
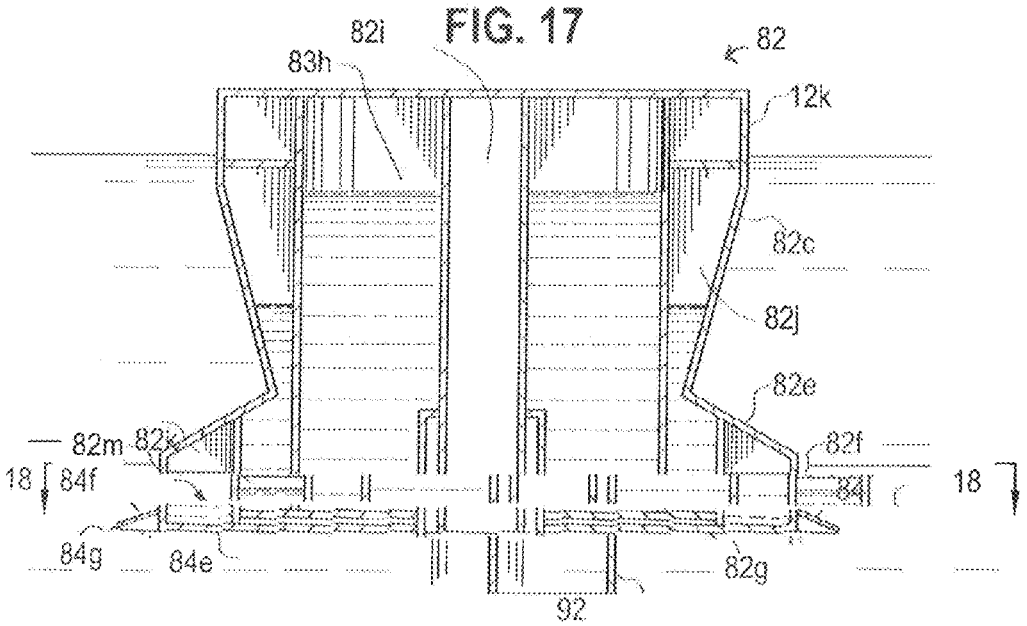
FIG. 17 is a side elevation of the Figure of FIG. 15 shown in cross-section.

FIG. 17 is the elevation of FIG. 15 in a vertical cross-section showing a simplified view of the tankage within hull 82 in cross-section. The produced resource flowing through production risers is stored in an inner annular tank A central vertical tank 82*i* can be used as a separator vessel, such as for separating oil, water and/or gas, and/or for storage.

An outer, annular tank 82*j* having an outside wall conforming to the shape of upper conical section 82*c* and lower conical section 82*e* can be used to hold ballast water and/or to store the produced resource. In this embodiment, an outer, ring-shaped tank 82*k* is a void that has a cross-section of an irregular trapezoid defined on its top by lower conical section 82*e* and lower cylindrical section 82*f* with a vertical inner side wall and a horizontal lower bottom wall, although tank 82*k* could be used for ballast and/or storage.

A torus-shaped tank 82*m*, which is shaped like a washer or doughnut having a square or rectangular cross-section, is located in a lowermost and outermost portion of hull 82. Tank 82*m* can be used for storage of a produced resource and/or ballast water. In one embodiment, tank 82*m* holds a slurry of hematite and water, and in a further embodiment, tank 82*m* contains about 1 part hematite and about 3 parts water.

Fins 84 for reducing heave are shown in cross-section in FIG. 17. Each section of fins 84 has the shape of a right triangle in a vertical cross-section, where the 90° angle is located adjacent a lowermost outer side wall of lower cylindrical section 82*f* of hull 82, such that a bottom edge 84*e* of the triangle shape is co-planar with the bottom surface 82*g* of hull 82, and a hypotenuse 84*f* of the triangle shape extends from a distal end 84*g* of the bottom edge 84*e* of the triangle shape upwards and inwards to attach to the outer side wall of lower cylindrical section 82*f* at a point only slightly higher than the lowermost edge of the outer side wall of lower cylindrical section 82 as can be seen in FIG. 17.

Some experimentation may be required to size fins 84 for optimum effectiveness. A starting point is bottom edge 84*e* extends radially outwardly a distance that is about half the vertical height of lower cylindrical section 82*f*, and hypotenuse 84*f* attaches to lower cylindrical section 82*f* about one quarter up the vertical height of lower cylindrical section 82*f* from the bottom 82*g* of hull 82. Another starting point is that if the radius of lower cylindrical section 82*f* is R, then bottom edge 84*e* of fin 84 extends radially outwardly an additional 0.05 to 0.20 R, preferably about 0.10 to 0.15 R, and more preferably about 0.125 R.

Figure 18:
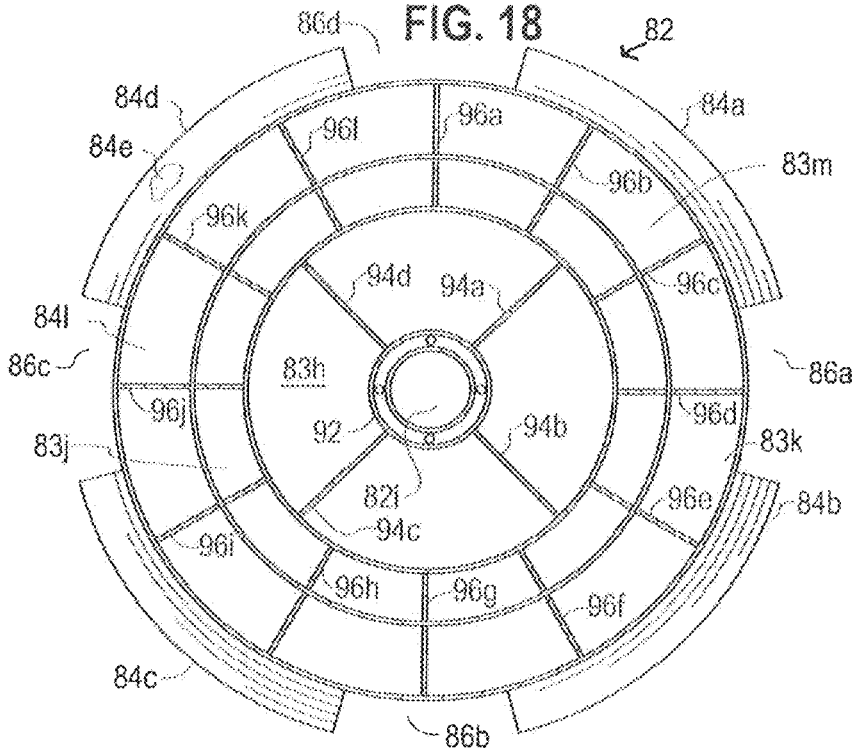
FIG. 18 is a cross section of the vessel of FIG. 17 as seen along the line 18-18 in FIG. 17.

FIG. 18 is a cross-section of hull 82 of the floating driller and/or the floating driller 80 as seen along the line 18-18 in FIG. 17.

Radial support members 94*a*, 94*b*, 94*c* and 94*d* provide structural support for inner, annular tank 83*h*, which is shown as having four compartments separated by the radial support members 94. Radial support members 96*a*, 96*b*, 96*c*, 96*d*, 96*e*, 96*f*, 96*g*, 96*h*, 96*i*, 96*j*, 96*k*, and 961 provide structural support for outer, annular tank 82*j* and tanks 82*k* and 82*m*. Outer, annular tank 82*j* and tanks 82*k* and 82*m* are compartmentalized by the radial support members 96.

A floating driller according to the present invention, such as the floating driller can be made onshore, preferably at a shipyard using conventional ship building materials and techniques.

The floating driller preferably has a circular shape in a plan view, but construction cost may favor a polygonal shape so that flat, planar metal plates can be used rather than bending plates into a desired curvature.

The floating driller's hull having a polygonal shape with facets in a plan view, such as described in U.S. Pat. No. 6,761,508, issued to Haun and incorporated by reference, is included in the present invention.

If a polygonal shape is chosen and if a moveable hawser connection is desired, then a tubular channel or rail can be designed with an appropriate radius of curvature and mounted with appropriate standoffs so as to provide the moveable hawser connection. If the floating driller is built according to the description of the floating driller 10 in FIGS. 1-4, then it may be preferred to move the floating driller, without a center column, to its final destination, anchor the floating driller at its desired location, and install the center column offshore after the floating driller has been moved and anchored in position. For the embodiment illustrated in FIGS. 7 and 9, it would likely be preferred to install the center column while the floating driller is onshore, retract the center column to an uppermost position, and tow the floating driller to its final destination with the center column installed by fully retracted. After the floating driller is positioned at its desired location, the center column can be extended to a desired depth, and the mass trap on the bottom of the center column can be filled to help stabilize the hull against wind, wave and current action.

After the floating driller is anchored and its installation is otherwise complete, it can be used for drilling exploratory or production wells, provided a derrick is installed, and it can be used for production and storage of resources or products. To offload a fluid cargo that has been stored on the floating driller, a transport tanker is brought near the floating driller. With reference to FIGS. 1-4, a messenger line can be stored on reels 70*a* and/or 70*b*.

An end of the messenger line can be shot with a pyrotechnic gun from the floating driller 10 to tanker T and grabbed by personnel on tanker T. The other end of the messenger line can be attached to a tanker end (FIG. 2) of hawser 18, and the personnel on the tanker can pull hawser end 18*c* of hawser 18 to the tanker T, where it can be attached to an appropriate structure on tanker T.

The personnel on tanker T can then shoot one end of the messenger line to personnel on the floating driller, who hook that end of the messenger line to a tanker end 20*a* (FIG. 2) of hose 20. Personnel on the tanker can then pull tanker end of hose 20 to the tanker and fasten it to an appropriate connection on the tanker for fluid communication between the floating driller and the tanker. Typically, cargo will be offloaded from storage on the floating driller to the tanker, but the opposite can also be done, where cargo from the tanker is offloaded to the floating driller for storage.

Although the hose may be large, such as 20 inches in diameter, the hose hook-up and the offloading operation can take a long time, typically many hours but less than a day. During this time, tanker T will typically weathervane downwind of the floating driller and move about some as wind direction changes, which is accommodated on the floating driller through the moveable hawser connection, allowing considerable movement of the tanker with respect to the floating driller, possibly through a 270-degree are, without interrupting the offloading operation. In the event of a major storm or squall, the offloading operation can be stopped, and if desired, the tanker can be disconnected from the floating driller by releasing hawser 18.

After completion of a typical and uneventful offloading operation, the hose end can be disconnected from the tanker, and a hose reel 20*b* can be used to reel hose 20 back into stowage on hose reel 20*b* on the floating driller.

A second hose and hose reel 72 is provided on the floating driller for use in conjunction with the second moveable hawser connection 60 on the opposite side of the floating driller 10. Tanker end 18*c* of hawser 18 can then be disconnected, allowing tanker T to move away and transport the cargo it received to port facilities onshore. The messenger line can be used to pull tanker end 18*c* of hawser 18 back to the floating driller, and the hawser can either float on the water adjacent the floating driller, or the tanker end 18*c* of hawser 18 can be attached to a reel (not shown) on the deck 12*a* of the floating driller 10, and the hawser 18 can be reeled onto the reel for stowage on the floating driller, while dual ends 51*ba* and 51*c* (FIG. 12) of hawser 18 remain connected to moveable hawser connection 40.

Having described the invention above, various modifications of the techniques, procedures, materials, and equipment will be apparent to those skilled in the art. It is intended that all such variations within the scope and spirit of the invention be included within the scope of the appended claims.

A need exists for a buoyant structure that provides kinetic energy absorption capabilities from a watercraft by providing a plurality of dynamic movable tendering mechanisms in a tunnel formed in the buoyant structure.

A further need exists for a buoyant structure that provides wave damping and wave breakup within a tunnel formed in the buoyant structure.

A need exists for a buoyant structure that provides friction forces to a hull of a watercraft in the tunnel.

The embodiments enable safe entry of a watercraft into a buoyant structure in both harsh and benign offshore water environments, with 4 foot to 40 foot seas.

The embodiments prevent injuries to personnel from equipment falling off the buoyant structure by providing a tunnel to contain and protect watercraft for receiving personnel within the buoyant structure.

The embodiments provide a buoyant structure located in an offshore field that enables a quick exit from the offshore structure by many personnel simultaneously, in the case of an approaching hurricane or tsunami.

The embodiments provide a means to quickly transfer many personnel, such as from 200 to 500 people safely from an adjacent platform on fire to the buoyant structure in less than 1 hour.

The embodiments enable the offshore structure to be towed to an offshore disaster and operate as a command center to facilitate in the control of a disaster, and can act as a hospital, or triage center.

Figure 19:
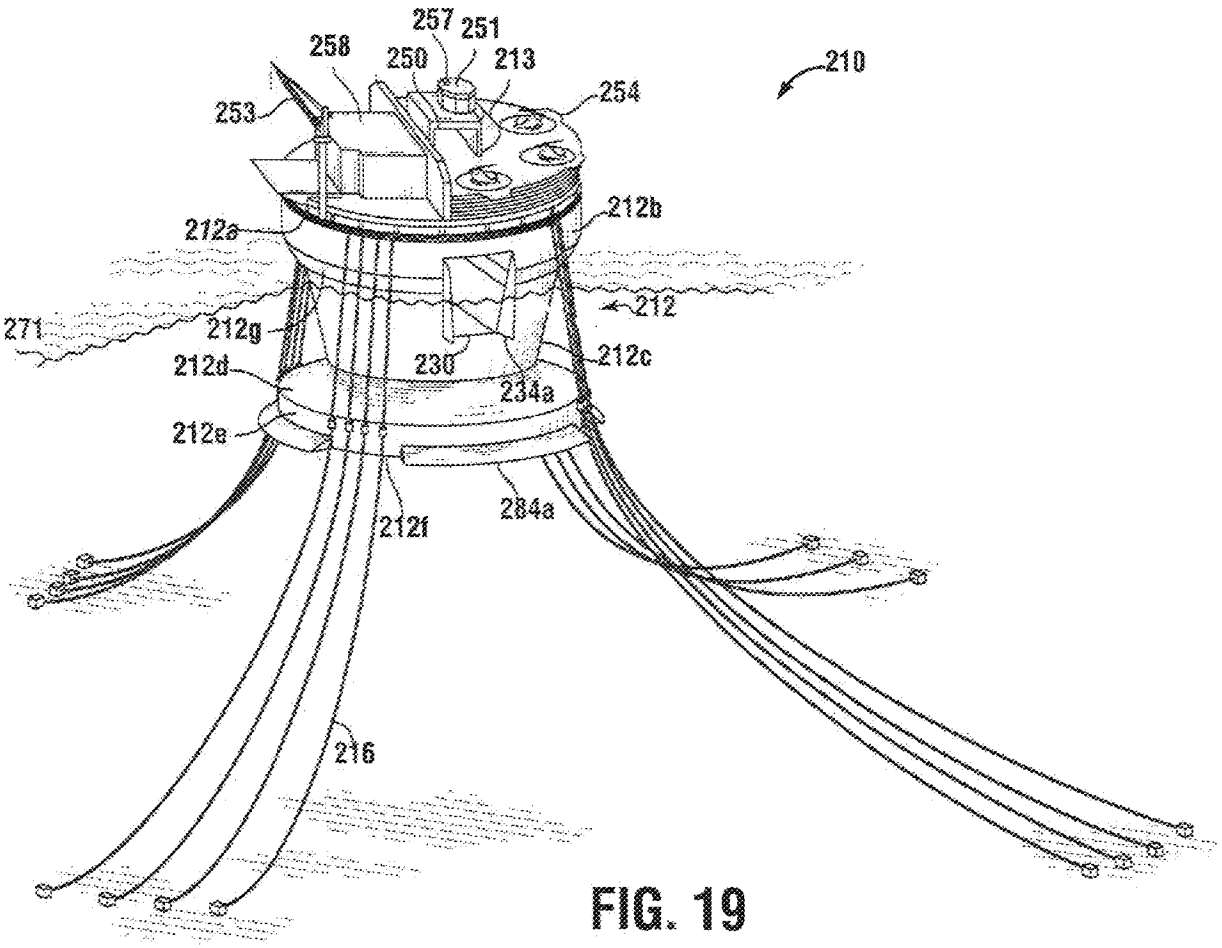
FIG. 19 is a perspective view of a buoyant structure.

FIG. 19 depicts a buoyant structure for operationally supporting offshore exploration, drilling, production, and storage installations according to an embodiment of the invention.

Figure 20:
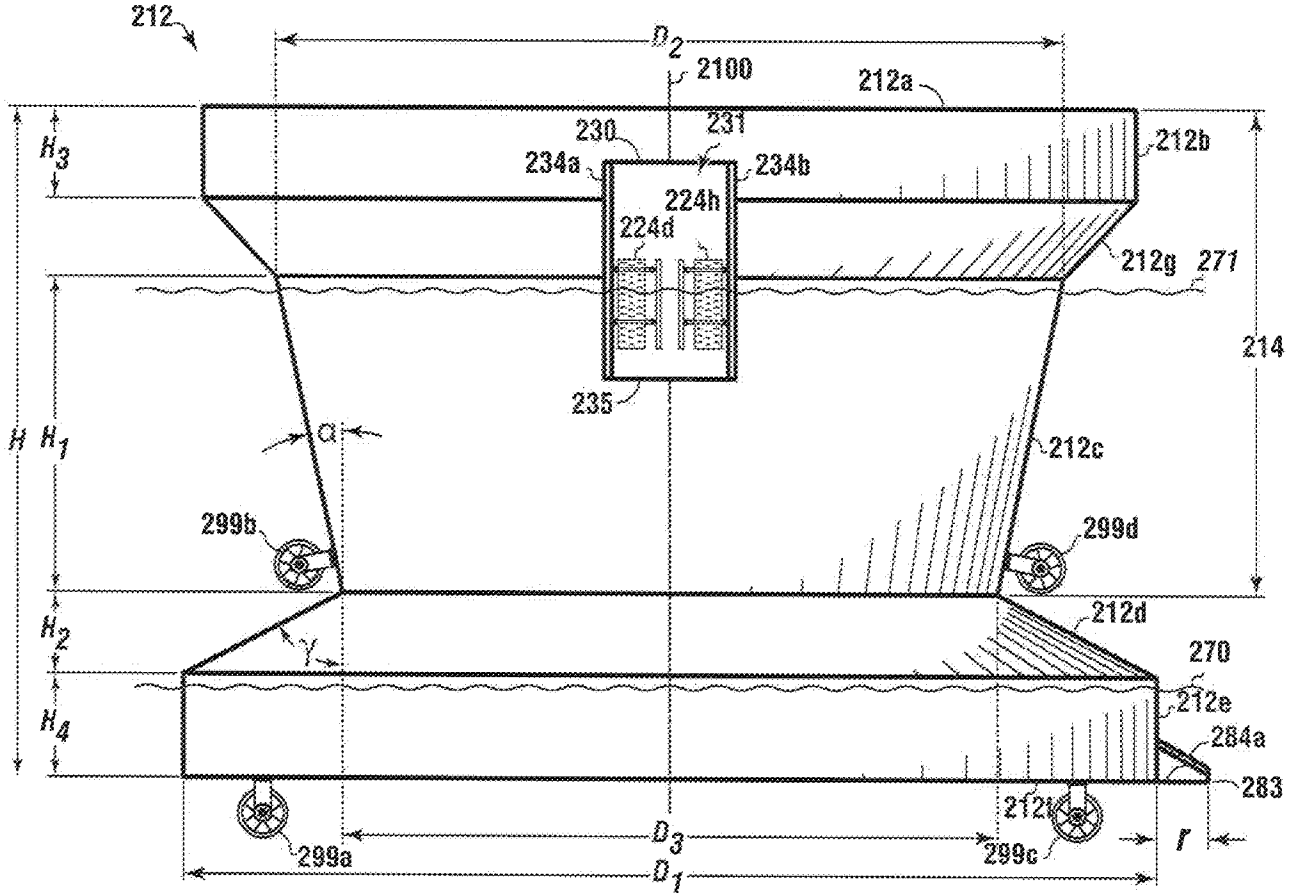
FIG. 20 is a vertical profile drawing of the hull of the buoyant structure.

FIGS. 19 and 20 should be viewed together. The buoyant structure 210 can include a hull 212, which can carry a superstructure 213 thereon. The superstructure 213 can include a diverse collection of equipment and structures, such as living quarters and crew accommodations 258, equipment storage, a heliport 254, and a myriad of other structures, systems, and equipment, depending on the type of offshore operations to be supported. Cranes 253 can be mounted to the superstructure. The hull 212 can be moored to the seafloor by a number of catenary mooring lines 216. The superstructure can include an aircraft hangar 250. A control tower 251 can be built on the superstructure. The control tower can have a dynamic position system 257.

The buoyant structure 210 can have a tunnel 230 with a tunnel opening in the hull 212 to locations exterior of the tunnel.

The tunnel 230 can receive water while the buoyant structure 210 is at an operational depth 271.

The buoyant structure can have a unique hull shape.

Referring to FIGS. 19 and 20, the hull 212 of the buoyant structure 210 can have a main deck 212*a*, which can be circular; and a height H (shown in FIG. 20). Extending downwardly from the main deck 212*a* can be an upper frustoconical portion 214 shown in FIG. 20.

FIGS. 19 and 20 show embodiments wherein, the upper frustoconical portion 214 can have an upper cylindrical side section 212*b* extending downwardly from the main deck 212*a*, an inwardly-tapering upper frustoconical side section 212*g* located below the upper cylindrical side section 212*b* and connecting to a lower inwardly-tapering frustoconical side section 212*c*.

The buoyant structure 210 also can have a lower frustoconical side section 212*d* extending downwardly from the lower inwardly-tapering frustoconical side section 212*c* and flares outwardly. Both the lower inwardly-tapering frustoconical side section 212*c* and the lower frustoconical side section 212*d* can be below the operational depth 271.

A lower ellipsoidal section 212*e* can extend downwardly from the lower frustoconical side section 212*d*, and a matching ellipsoidal keel 212*f*.

Referring to both FIGS. 19 and 20, the lower inwardly-tapering frustoconical side section 212*c* can have a substantially greater vertical height H1 than lower frustoconical side section 212*d* shown as H2. Upper cylindrical side section 212*b* can have a slightly greater vertical height H3 than lower ellipsoidal section 212*e* shown as H4.

As shown in FIGS. 19 and 20, the upper cylindrical side section 212*b* can connect to inwardly-tapering upper frustoconical side section 212*g* so as to provide for a main deck of greater radius than the hull radius along with the superstructure 213, which can be round, square or another shape, such as a half moon. Inwardly-tapering upper frustoconical side section 212*g* can be located above the operational depth 271.

The tunnel 230 can have at least one closable door, two closable doors 234*a* and 234*b* are depicted in these Figures that alternatively or in combination, can provide for weather and water protection to the tunnel 230.

Fin-shaped appendages 284 can be attached to a lower and an outer portion of the exterior of the hull. FIG. 20 shows an embodiment with the fin shaped appendages having a planar face on a portion of the fin extending away from the hull 212. In FIG. 20, the fin shaped appendages extend a distance "r" from the lower ellipsoidal section 212*e*.

The hull 212 is depicted with a plurality of catenary mooring lines 216 for mooring the buoyant structure to create a mooring spread.

In the more simplified view in FIG. 20 two different depths are shown, the operational depth 271 and the transit depth 270.

The dynamic movable tendering mechanisms 224*d* and 224*h* can be oriented above the tunnel floor 235 and can have portions that are positioned both above the operational depth 271 and extend below the operational depth 271 inside the tunnel 230.

The main deck 212*a*, upper cylindrical side section 212*b*, inwardly-tapering upper frustoconical side section 212*g*, lower inwardly-tapering frustoconical side section 212*c*, lower frustoconical side section 212*d*, lower ellipsoidal section 212*e*, and matching ellipsoidal keel 212*f* can all be co-axial with a common vertical axis 2100. In embodiments, the hull 212 can be characterized by an ellipsoidal cross section when taken perpendicular to the vertical axis 2100 at any elevation.

Due to its ellipsoidal planform, the dynamic response of the hull 212 is independent of wave direction (when neglecting any asymmetries in the mooring system, risers, and underwater appendages), thereby minimizing wave-induced yaw forces. Additionally, the conical form of the hull 212 is structurally efficient, offering a high payload and storage volume per ton of steel when compared to traditional ship-shaped offshore structures. The hull 212 can have ellipsoidal walls which are ellipsoidal in radial cross-section, but such shape may be approximated using a large number of flat metal plates rather than bending plates into a desired curvature. Although an ellipsoidal hull planform is preferred, a polygonal hull planform can be used according to alternative embodiments.

In embodiments, the hull 212 can be circular, oval or elliptical forming the ellipsoidal planform.

An elliptical shape can be advantageous when the buoyant structure is moored closely adjacent to another offshore platform so as to allow gangway passage between the two structures. An elliptical hull can minimize or eliminate wave interference.

The specific design of the lower inwardly-tapering frustoconical side section 212*c* and the lower frustoconical side section 212*d* generates a significant amount of radiation damping resulting in almost no heave amplification for any wave period, as described below.

Lower inwardly-tapering frustoconical side section 212*c* can be located in the wave zone. At operational depth 271, the waterline can be located on lower inwardly-tapering frustoconical side section 212*c* just below the intersection with upper cylindrical side section 212*b*. Lower inwardly-tapering frustoconical side section 212*c* can slope at an angle (a) with respect to the vertical axis 2100 from 10 degrees to 15 degrees. The inward flare before reaching the waterline significantly dampens downward heave, because a downward motion of the hull 212 increases the waterplane area. In other words, the hull area normal to the vertical axis 2100 that breaks the water's surface will increase with downward hull motion, and such increased area is subject to the opposing resistance of the air and or water interface. It has been found that 10 degrees to 15 degrees of flare provides a desirable amount of damping of downward heave without sacrificing too much storage volume for the vessel.

Similarly, lower frustoconical side section 212*d* dampens upward heave. The lower frustoconical side section 212*d* can be located below the wave zone (about 30 meters below the waterline). Because the entire lower frustoconical side section 212*d* can be below the water surface, a greater area (normal to the vertical axis 2100) is desired to achieve upward damping. Accordingly, the first diameter D1 of the lower hull section can be greater than the second diameter D2 of the lower inwardly-tapering frustoconical side section 212*c*. The lower frustoconical side section 212*d* can slope at an angle (g) with respect to the vertical axis 2100 from 55 degrees to 65 degrees. The lower section can flare outwardly at an angle greater than or equal to 55 degrees to provide greater inertia for heave roll and pitch motions. The increased mass contributes to natural periods for heave pitch and roll above the expected wave energy. The upper bound of 65 degrees is based on avoiding abrupt changes in stability during initial ballasting on installation. That is, lower frustoconical side section 212*d* can be perpendicular to the vertical axis 2100 and achieve a desired amount of upward heave damping, but such a hull profile would result in an undesirable step-change in stability during initial ballasting on installation. The connection point between upper frustoconical portion 214 and the lower frustoconical side section 212*d* can have a third diameter D3 smaller than the first and second diameters D1 and D2.

The transit depth 270 represents the waterline of the hull 212 while it is being transited to an operational offshore position. The transit depth is known in the art to reduce the amount of energy required to transit a buoyant vessel across distances on the water by decreasing the profile of buoyant structure which contacts the water. The transit depth is roughly the intersection of lower frustoconical side section 212*d* and lower ellipsoidal section 212*e*. However, weather and wind conditions can provide need for a different transit depth to meet safety guidelines or to achieve a rapid deployment from one position on the water to another.

In embodiments, the center of gravity of the offshore vessel can be located below its center of buoyancy to provide inherent stability. The addition of ballast to the hull 212 is used to lower the center of gravity. Optionally, enough ballast can be added to lower the center of gravity below the center of buoyancy for whatever configuration of superstructure and payload is to be carried by the hull 212.

The hull is characterized by a relatively high metacenter. But, because the center of gravity (CG) is low, the metacentric height is further enhanced, resulting in large righting moments. Additionally, the peripheral location of the fixed ballast further increases the righting moments.

The buoyant structure aggressively resists roll and pitch and is said to be "stiff." Stiff vessels are typically characterized by abrupt jerky accelerations as the large righting moments counter pitch and roll. However, the inertia associated with the high total mass of the buoyant structure, enhanced specifically by the fixed ballast, mitigates such accelerations. In particular, the mass of the fixed ballast increases the natural period of the buoyant structure to above the period of the most common waves, thereby limiting wave-induced acceleration in all degrees of freedom.

In an embodiment, the buoyant structure can have thrusters 299*a*-299*d*.

Figure 21:
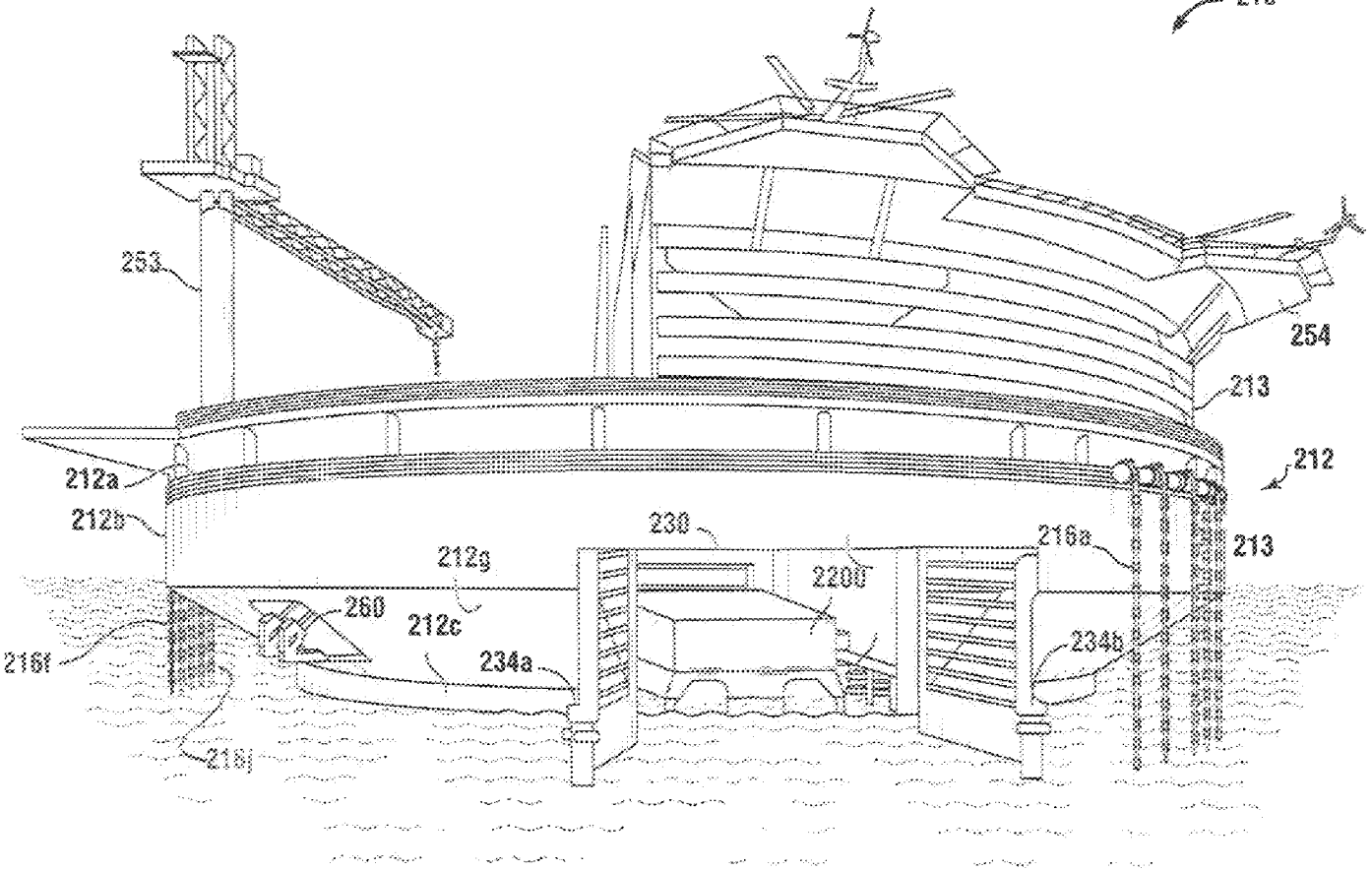
FIG. 21 is an enlarged perspective view of the floating buoyant structure at operational depth.

FIG. 21 shows the buoyant structure 210 with the main deck 212*a* and the superstructure 213 over the main deck.

In embodiments, the crane 253 can be mounted to the superstructure 213, which can include a heliport 254.

A plurality of catenary mooring lines 216*a*-216*e* and 216*f*-216*j* are shown coming from the upper cylindrical side section 212*b*.

A berthing facility 260 is shown in the hull 212 in the portion of the inwardly-tapering upper frustoconical side section 212*g*. The inwardly-tapering upper frustoconical side section 212*g* is shown connected to the lower inwardly-tapering frustoconical side section 212*c* and the upper cylindrical side section 212*b*.

FIG. 21 depicts an enlarged perspective view of the hull with an opening 230 in the hull for receiving a watercraft 2200. The tunnel 230 can have at least one closable door 234*a* and 234*b* that alternatively or in combination, can provide for weather and water protection to the tunnel 230.

The dynamic movable tendering mechanisms can be oriented above the tunnel floor 235 and can have portions that are positioned both above the operational depth 271 and extend below the operational depth 271 inside the tunnel 230.

Figure 22:
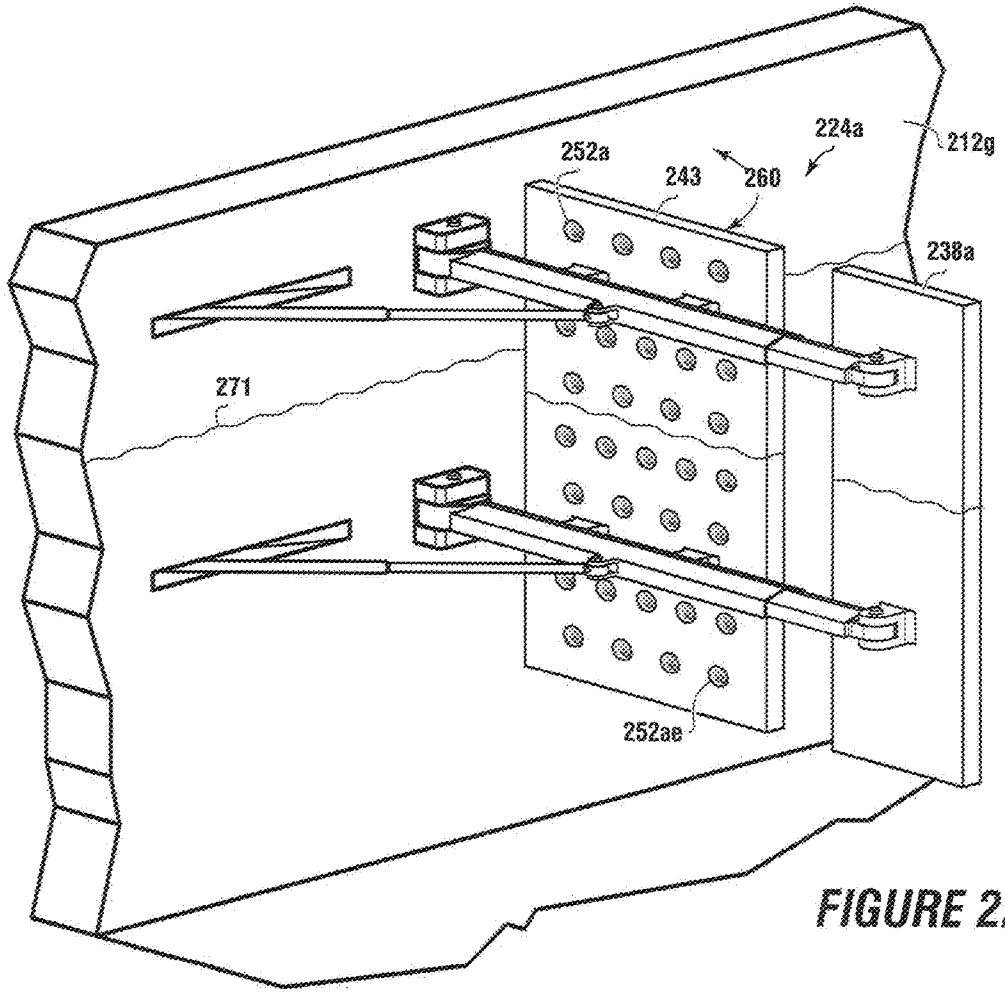
FIG. 22 is an elevated perspective view of one of the dynamic moveable tendering mechanisms.

FIG. 22 shows a plurality of openings 252*a*-252*ae* in a plate 243 can reduce wave action in the opening 230 in the hull.

Each of the plurality of openings can have a diameter from 0.1 meters to 2 meters. In embodiments, the plurality of openings 252 can be shaped as ellipses.

The buoyant structure can have a transit depth and an operational depth, wherein the operational depth 271 is achieved using ballast pumps and filling ballast tanks in the hull with water after moving the structure at transit depth to an operational location.

The transit depth can be from about 7 meters to about 15 meters, and the operational depth can be from about 45 meters to about 65 meters. The tunnel can be out of water during transit.

Straight, curved, or tapering sections in the hull can form the tunnel.

In embodiments, the plates, closable doors, and hull can be made from steel.

FIG. 22 is an elevated perspective view of one of the dynamic moveable tendering mechanisms. Secondary plates 238*a* and secure to a primary plate 243 for additional wave damping. Elements similar to the prior drawings are also labelled.

Figure 23:
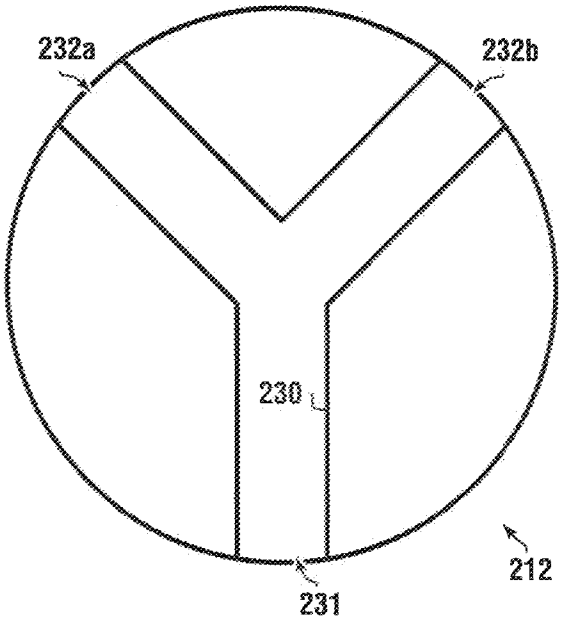
FIG. 23 is a top view of a Y-shaped tunnel in the hull of the buoyant structure.

FIG. 23 is a top view of a Y-shaped tunnel in the hull of the buoyant structure. The opening 230 is depicted with a first opening through the hull 231 and secondary openings through the hull 232*a* and 232*b*.

Figure 24:
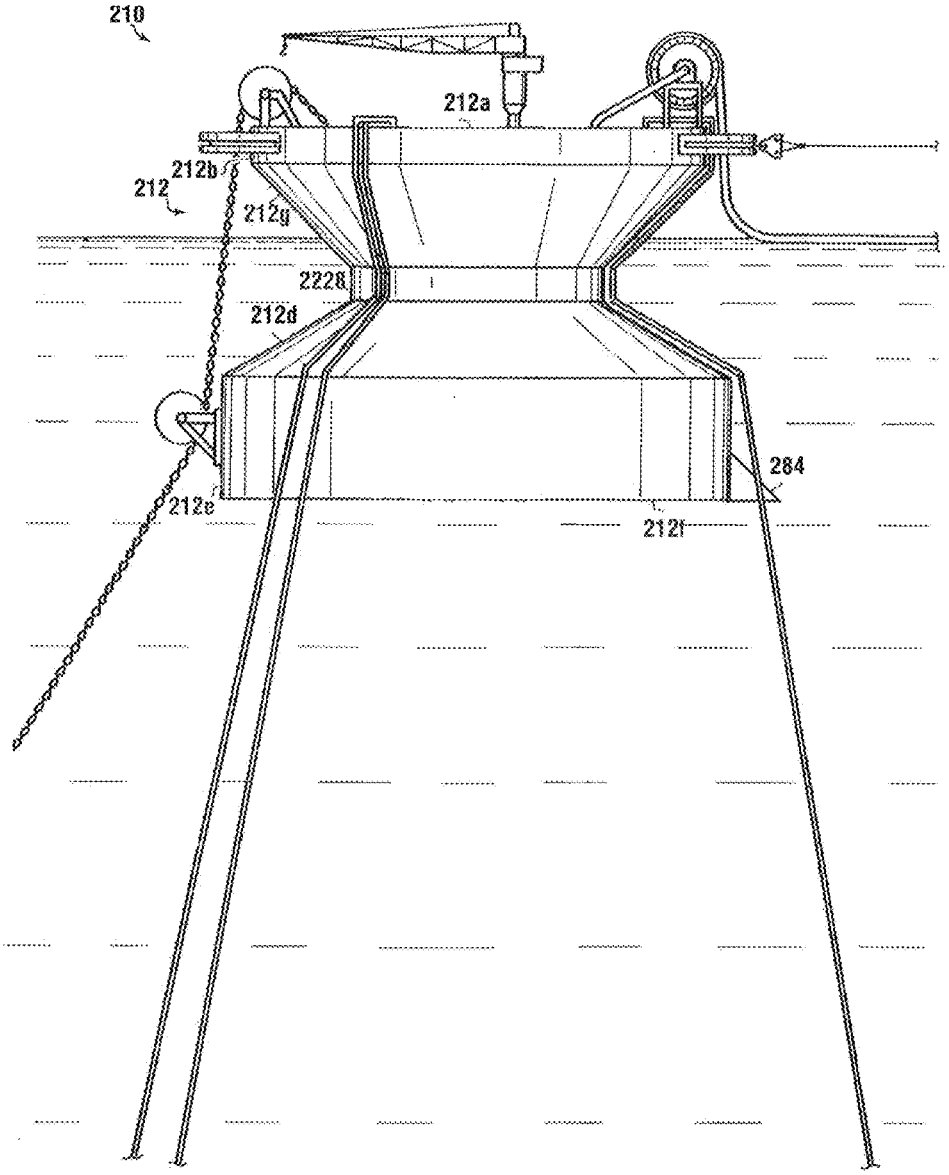
FIG. 24 is a side view of the buoyant structure with a cylindrical neck.

FIG. 24 is a side view of the buoyant structure with a cylindrical neck 2228.

The buoyant structure 210 is shown having a hull 212 with a main deck 212*a*.

The buoyant structure 210 has an upper cylindrical side section 212*b* extending downwardly from the main deck

212*a* and an upper frustoconical side section 212*g* extending from the upper cylindrical side section 212*b*.

The buoyant structure 210 has a cylindrical neck 2228 connecting to the upper frustoconical side section 212*g*.

A lower frustoconical side section 212*d* extends from the cylindrical neck 2228.

A lower ellipsoidal section 212*e* connects to the lower frustoconical side section 212*d*.

An ellipsoid keel 212*f* is formed at the bottom of the lower ellipsoidal section 212*e*.

A fin-shaped appendage 284 is secured to a lower and an outer portion of the exterior of the ellipsoid keel 212*f*.

FIG. 25 is detailed view of the buoyant structure 210 with a cylindrical neck 2228.

A fin-shaped appendage 284 is shown secured to a lower and an outer portion of the exterior of the ellipsoid keel and extends from the ellipsoid keel into the water.

FIG. 26 is a cut away view of the buoyant structure 210 with a cylindrical neck 2228 in a transport configuration.

In embodiments, the buoyant structure 210 can have a pendulum 2116, which can be moveable. In embodiments, the pendulum is optional and can be partly incorporated into the hull to provide optional adjustments to the overall hull performance.

In this Figure, the pendulum 2116 is shown at a transport depth.

In embodiments, the moveable pendulum can be configured to move between a transport depth and an operational depth and the pendulum can be configured to dampen movement of the watercraft as the watercraft moves from side to side in the water.

In embodiments, the hull can have the bottom surface and the deck surface.

In embodiments, the hull can be formed using at least two connected sections engaging between the bottom surface and the deck surface.

In embodiments, the at least two connected sections can be joined in series and symmetrically configured about a vertical axis with the connected sections extending downwardly from the deck surface toward the bottom surface.

In further embodiments, the connected sections can be at least two of: the upper cylindrical portion; the neck section; and the lower conical section.

While these embodiments have been described with emphasis on the embodiments, it should be understood that within the scope of the appended claims, the embodiments might be practiced other than as specifically described herein.

What is claimed is:

1. A floating driller comprising:

a. a hull with a hull plan view that is circular or polygonal, wherein the hull comprises:
   (i) a bottom surface;
   (ii) a top deck surface; and
   (iii) at least two connected sections engaging between the bottom surface and the top deck surface, the at least two connected sections joined in series and symmetrically configured about a vertical axis with one of the connected sections extending downwardly from the top deck surface toward the bottom surface, the at least two connected sections comprising at least two of:
      (1) an upper portion in profile or section view with a sloping side extending from the top deck section;
      (2) a cylindrical neck section in profile view; and
      (3) a lower conical section in profile view with a sloping side extending from the cylindrical neck section;

b. at least one extending fin with an upper fin surface sloping towards the bottom surface and secured to and extending from the hull, the at least one extending fin configured to provide hydrodynamic performance through linear and quadratic damping, and wherein the hull provides added mass with improved hydrodynamic performance through linear and quadratic damping to the hull, and wherein the floating driller does not require a retractable center column to control pitch, roll and heave, and c. a plurality of sloping connected sides forming the lower conical section, each sloping connected side having at least one of: identical angles for each sloping side and different angles for each sloping side.

2. The floating driller of claim 1, wherein the hull is a shape inscribed within a circle.

3. The floating driller of claim 1, further comprising a dynamic positioning system with thrusters for providing positioning of the floating driller.

4. The floating driller of claim 1, wherein the at least one extending fin comprises added mass resulting in additional fluid displacement that improves heave control of the floating driller.

5. The floating driller of claim 1, comprising a sloping extension segment between the plurality of sloping connected sides.

6. The floating driller of claim 1, wherein the at least one extending fin is a plurality of segmented extending fins aligned with each other and attached circumferentially around the hull.

7. The floating driller of claim 1 comprising a recess in the hull and wherein the recess is a moon pool.

8. The floating driller of claim 1, wherein the polygonal shape of the hull comprises a plurality of flat planar metal plates forming a curvature of the hull.

9. The floating driller of claim 1, wherein the extending fins are tanks.

10. The floating driller of claim 1, further comprising an extending bottom edge extending from the extending fin decreasing hull motion.

11. A floating driller comprising:

a. a hull with a hull plan view that is circular or polygonal, wherein the hull comprises:
   (i) a bottom surface;
   (ii) a top deck surface; and
   (iii) at least two connected sections engaging between the bottom surface and the top deck surface, the at least two connected sections joined in series and symmetrically configured about a vertical axis with one of the connected sections extending downwardly from the top deck surface toward the bottom surface, the at least two connected sections comprising at least two of:
      (1) an upper portion in profile or section view with a sloping side extending from the top deck section;
      (2) a cylindrical neck section in profile view; and
      (3) a lower conical section in profile view with a sloping side extending from the cylindrical neck section; and b. at least one extending fin with an upper fin surface sloping towards the bottom surface and secured to and extending from the hull, the at least one extending fin configured to provide hydrodynamic performance through linear and quadratic damping, wherein the extending fin comprises a planar face on a distal end of fin, the planar face in parallel with a vertical axis of the floating driller; and wherein the hull provides added mass with improved hydrodynamic performance through linear and quadratic damping to the hull, and wherein the floating driller does not require a retractable center column to control pitch, roll and heave.

12. A floating driller comprising:

a. a hull with a hull plan view that is circular or polygonal, wherein the hull comprises:

(i) a bottom surface;

(ii) a top deck surface; and (iii) at least two connected sections engaging between the bottom surface and the top deck surface, the at least two connected sections joined in series and symmetrically configured about a vertical axis with one of the connected sections extending downwardly from the top deck surface toward the bottom surface, the at least two connected sections comprising at least two of:

(1) an upper portion in profile or section view with a sloping side extending from the top deck section;

(2) a cylindrical neck section in profile view; and (3) a lower conical section in profile view with a sloping side extending from the cylindrical neck section; and b. at least one extending fin with an upper fin surface sloping towards the bottom surface and secured to and extending from the hull, the at least one extending fin configured to provide hydrodynamic performance through linear and quadratic damping, wherein the extending fin is a tapered plate extending from the hull; and wherein the hull provides added mass with improved hydrodynamic performance through linear and quadratic damping to the hull, and wherein the floating driller does not require a retractable center column to control pitch, roll and heave.

* * * * *